US009677780B2

(12) United States Patent
Nakagawa

(10) Patent No.: US 9,677,780 B2
(45) Date of Patent: Jun. 13, 2017

(54) CONTROLLER AND AIR CONDITIONING PROCESSING SYSTEM

(75) Inventor: Yoshihiro Nakagawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1040 days.

(21) Appl. No.: 13/822,938

(22) PCT Filed: Sep. 27, 2011

(86) PCT No.: PCT/JP2011/071985
§ 371 (c)(1),
(2), (4) Date: Mar. 13, 2013

(87) PCT Pub. No.: WO2012/043526
PCT Pub. Date: Apr. 5, 2012

(65) Prior Publication Data

US 2013/0167571 A1 Jul. 4, 2013

(30) Foreign Application Priority Data

Sep. 30, 2010 (JP) ..... 2010-221237

(51) Int. Cl.
*F25B 13/00* (2006.01)
*F24F 11/00* (2006.01)

(52) U.S. Cl.
CPC ..... *F24F 11/0008* (2013.01); *F24F 11/0015* (2013.01); *F24F 2011/0047* (2013.01);
(Continued)

(58) Field of Classification Search
CPC .... F24F 11/0015; F24F 11/008; F24F 3/1429; F24F 2011/0045; F24F 3/1411;
(Continued)

(56) References Cited

U.S. PATENT DOCUMENTS 4,610,148 A * 9/1986 Shelton ..... F25B 17/083 62/106
2003/0010047 A1* 1/2003 Shimoda ..... F25B 13/00 62/228.3

(Continued)

FOREIGN PATENT DOCUMENTS

JP 10-26389 A 1/1998
JP 10026389 A * 1/1998

(Continued)

OTHER PUBLICATIONS

International Preliminary Report of corresponding PCT Application No. PCT/JP2011/071985.

(Continued)

*Primary Examiner* — Frantz Jules
*Assistant Examiner* — Meraj A Shaikh
(74) *Attorney, Agent, or Firm* — Global IP Counselors, LLP

(57) ABSTRACT

A controller controls the operations of a humidity control apparatus and an air conditioner. The controller includes a power consumption detector, a target value setting processor, and an operation control unit. The power consumption detector detects the power consumption of the humidity control apparatus and the air conditioner. The target value setting processor performs optimal target value setting processing by performing first or second processing. The first processing lowers a target operating frequency of a humidity controlling compressor and a target evaporation temperature in a utilization-side heat exchanger. The second processing raises the target operating frequency and the target evaporation temperature. The optimal target value setting processing sets the target operating frequency and the target evaporation temperature so as to minimize the power consumption. The operation control unit controls the humidity control apparatus to achieve the target operating fre- (Continued)

quency and the air conditioner to achieve the target evaporation temperature.

16 Claims, 9 Drawing Sheets

(52) U.S. Cl.
CPC ..... *F24F 2011/0058* (2013.01); *F24F 2011/0068* (2013.01)

(58) Field of Classification Search
CPC ..... F24F 11/0012; F25B 13/00; F25B 49/02; F25B 2313/0233; F25B 2313/0314; F25B 2313/02741
USPC ..... 62/271; 700/278
See application file for complete search history.

(56) References Cited

U.S. PATENT DOCUMENTS

2007/0144189 A1 6/2007 Ishida et al.
2007/0180851 A1* 8/2007 Fujiyoshi ..... F24F 3/1411 62/480
2009/0064697 A1* 3/2009 Kondo ..... F24F 11/0015 62/271

FOREIGN PATENT DOCUMENTS

| | | | | |
|---|---|---|---|---|
| JP | 11-304285 | A | | 11/1999 |
| JP | 11304285 | A | * | 11/1999 |
| JP | 2001-289485 | A | | 10/2001 |
| JP | 2001289485 | A | * | 10/2001 |
| JP | 2003-106609 | A | | 4/2003 |
| JP | 2004-308962 | A | | 11/2004 |
| JP | 2004308962 | A | * | 11/2004 |
| JP | 2004-340549 | A | | 12/2004 |
| JP | 2004340549 | A | * | 12/2004 |
| JP | 2005-291570 | A | | 10/2005 |
| JP | 2006-329579 | A | | 7/2006 |
| JP | 2006-329468 | A | | 12/2006 |
| JP | 2006329579 | A | * | 12/2006 |

OTHER PUBLICATIONS

International Search Report of corresponding EP Application No. PCT/JP2011/071985.

* cited by examiner

CONTROLLER AND AIR CONDITIONING PROCESSING SYSTEM

CROSS-REFERENCE TO RELATED APPLICATIONS

This U.S. National stage application claims priority under 35 U.S.C. §119(a) to Japanese Patent Application Nos. 2010-221237, filed in Japan on Sep. 30, 2010, the entire contents of which are hereby incorporated herein by reference.

TECHNICAL FIELD

The present invention relates to a controller that controls operations of a humidity control apparatus and an air conditioner and to an air conditioning processing system that uses the controller.

BACKGROUND ART

Conventionally, the humidity control apparatus of JP-A No. 2005-291570, in which an adsorption heat exchanger carrying an adsorbent that adsorbs moisture is connected to a refrigerant circuit, is known. This humidity control apparatus is capable of switching between a dehumidifying operation and a humidifying operation due to the above-described adsorption heat exchanger functioning as an evaporator or a condenser as a result of switching the circulation direction of the refrigerant. For example, in the dehumidifying operation, the adsorbent is cooled by the refrigerant that evaporates in the adsorption heat exchanger and moisture in the air is adsorbed on this adsorbent. The air that has imparted its moisture to the adsorbent and been dehumidified is supplied to a room and the room is dehumidified. On the other hand, in the humidifying operation, the adsorbent is heated by the refrigerant that condenses in the adsorption heat exchanger and the moisture adsorbed on the adsorbent is desorbed. The air that contains this moisture and has been humidified is supplied to the room and the room is humidified.

Further, in JP-A No. 2003-106609, an air conditioner in which refrigerant circulates in a refrigerant circuit and which performs a vapor compression refrigeration cycle is disclosed. A compressor, an indoor heat exchanger, an expansion valve, an outdoor heat exchanger, and a four-way switching valve are connected to the refrigerant circuit of this air conditioner. This air conditioner is capable of reversing the circulation direction of the refrigerant by switching the four-way switching valve, and the air conditioner is capable of switching between a cooling operation and a heating operation. For example, in the cooling operation, air cooled in the indoor heat exchanger that works as an evaporator is supplied to a room and the room is cooled. On the other hand, in the heating operation, air heated in the indoor heat exchanger that works as a condenser is supplied to the room and the room is heated.

Generally, the air conditioning load of the entire control target space includes the latent heat load and the sensible heat load. Considering a case where the humidity control apparatus of JP-A No. 2005-291570 and the air conditioner of JP-A No. 2003-106609 are installed in the same space and made to perform latent heat processing and sensible heat processing, the humidity control apparatus and the air conditioner can both perform latent heat processing, which is air conditioning processing for the latent heat load, and sensible heat processing, which is air conditioning processing for the sensible heat load. For this reason, it can be said that the sum of the latent heat throughput processed by the humidity control apparatus and the latent heat throughput processed by the air conditioner is equal to the latent heat load of the entire space and that the sum of the sensible heat throughput processed by the humidity control apparatus and the sensible heat throughput processed by the air conditioner is equal to the sensible heat load of the entire space.

SUMMARY

Technical Problem

However, in this case, conventionally the humidity control apparatus and the air conditioner each perform control on their own, so the balance between the latent heat throughput processed by the humidity control apparatus and the latent heat throughput processed by the air conditioner and the balance between the sensible heat throughput processed by the humidity control apparatus and the sensible heat throughput processed by the air conditioner are not optimally controlled from the standpoint of total power consumption. For this reason, the air conditioning processing with respect to the air conditioning load of the entire space oftentimes becomes less efficient.

It is a object of the present invention to provide a controller that can efficiently control a humidity control apparatus and an air conditioner that are installed in the same space and to provide an air conditioning processing system that includes those.

Solution to Problem

A controller pertaining to a first aspect of the present invention is a controller that controls the operations of a humidity control apparatus and an air conditioner and comprises a power consumption detector, a target value setting processor, and an operation control unit. The humidity control apparatus has a humidity controlling refrigerant circuit and performs humidity control processing of a predetermined space. The humidity controlling refrigerant circuit comprises the interconnection of a humidity controlling compressor, a first adsorption heat exchanger, a second adsorption heat exchanger, a humidity controlling expansion mechanism, and a switching mechanism. The switching mechanism is capable of switching between a first switched state and a second switched state. The first switched state is a state that allows refrigerant discharged from the humidity controlling compressor to circulate in the order of the first adsorption heat exchanger, the humidity controlling expansion mechanism, and the second adsorption heat exchanger. The second switched state is a state that allows the refrigerant discharged from the humidity controlling compressor to circulate in the order of the second adsorption heat exchanger, the humidity controlling expansion mechanism, and the first adsorption heat exchanger. The air conditioner has an air conditioning refrigerant circuit and performs air conditioning processing of the predetermined space. The air conditioning refrigerant circuit comprises the interconnection of at least an air conditioning compressor, a heat source-side heat exchanger, a utilization-side heat exchanger, and an air conditioning expansion mechanism. The power consumption detector detects a power consumption of the humidity control apparatus and the air conditioner. The target value setting processor performs optimal target value setting processing by performing first processing or second processing. The first processing is processing that lowers a target operating frequency of the humidity controlling compressor and lowers a target evaporation temperature in the utilization-side heat exchanger. The second processing is processing that raises the target operating frequency and raises the target evaporation temperature. The optimal target value setting processing is processing that sets the target operating frequency and the target evaporation temperature in such a way as to minimize the power consumption. The operation control unit controls the humidity controlling compressor to achieve the target operating frequency and controls the air conditioning compressor and/or the air conditioning expansion mechanism to achieve the target evaporation temperature.

According to the controller pertaining to the first aspect, by performing the first processing or the second processing, the controller can optimally control the balance between the latent heat throughput processed by the humidity control apparatus and the latent heat throughput processed by the air conditioner and the balance between the sensible heat throughput processed by the humidity control apparatus and the sensible heat throughput processed by the air conditioner in such a way as to minimize the total power consumption. By performing the first processing, the controller can make the air conditioner process part of the latent heat load to be processed by the humidity control apparatus, and by performing the second processing, the controller can make the humidity control apparatus process part of the latent heat load to be processed by the air conditioner. For this reason, the controller can suppress the power consumption consumed by the humidity control apparatus and the air conditioner.

Further, in regard to the sensible heat throughput of the entire space, even if the sensible heat throughput processed by the humidity control apparatus increases or decreases, the air conditioner can perform sensible heat processing in accordance with the residual sensible heat throughput since the controller controls the target evaporation temperature of the utilization-side heat exchanger. For this reason, the temperature of the predetermined space can be easily maintained at the target temperature.

A controller pertaining to a second aspect of the present invention is the controller pertaining to the first aspect and further comprises a storage unit. The storage unit stores a power consumption minimizing logic in which the operating frequency of the humidity controlling compressor, the evaporation temperature in the utilization-side heat exchanger, the power consumption, and operating conditions are associated with one another. The target value setting processor sets the target operating frequency and the target evaporation temperature from the operating conditions at that time and the power consumption minimizing logic.

According to the controller pertaining to the second aspect, the controller performs the optimal target value setting processing on the basis of the power consumption minimizing logic stored in the storage unit, so the controller can quickly perform control that optimizes the balance between the latent heat throughput processed by the humidity control apparatus and the latent heat throughput processed by the air conditioner and the balance between the sensible heat throughput processed by the humidity control apparatus and the sensible heat throughput processed by the air conditioner. Consequently, the controller can shorten the amount of time until it minimizes the power consumption consumed by the humidity control apparatus and the air conditioner.

A controller pertaining to a third aspect of the present invention is the controller pertaining to the second aspect, wherein the operating conditions are conditions relating to a latent heat load and a sensible heat load in the predetermined space, a target temperature and a target humidity of the predetermined space, a space temperature and a space humidity of the predetermined space, and an outside air temperature and an outside air humidity.

According to the controller pertaining to the third aspect, provided that these operating conditions are determined, the target operating frequency and the target evaporation temperature are set on the basis of the power consumption minimizing logic. Consequently, the controller can shorten the amount of time until it minimizes the power consumption consumed by the humidity control apparatus and the air conditioner.

A controller pertaining to a fourth aspect of the present invention is the controller pertaining to the second aspect or the third aspect, wherein in a case where it is determined that the humidity of the predetermined space at that time is divergent from the target humidity of the predetermined space, the controller corrects the target operating frequency of the humidity controlling compressor in the power consumption minimizing logic in such a way that the humidity of the predetermined space matches the target humidity of the predetermined space.

In the present invention, the controller controls the target evaporation temperature of the utilization-side heat exchanger, so the controller can optimally control the sensible heat processing of the predetermined space without excess or deficiency. However, in regard to the latent heat processing of the predetermined space, there are cases where an excess or deficiency occurs with respect to the latent heat load and the humidity of the predetermined space becomes divergent from the target humidity of the predetermined space. This results from influences such as the installation conditions of the air conditioner and humidity control apparatus and the characteristics of devices.

According to the controller pertaining to the fourth aspect, in a case where the humidity of the predetermined space at that time is divergent from the target humidity of the predetermined space set by the user, the controller corrects the target operating frequency of the humidity controlling compressor in the power consumption minimizing logic in such a way that the humidity of the predetermined space becomes closer to the target humidity of the predetermined space. For this reason, even if an excess or deficiency in the latent heat throughput were to arise with respect to the latent heat load, the controller can revise the control state in such a way that the humidity of the predetermined space reliably reach the target humidity by controlling the target operating frequency of the humidity controlling compressor.

A controller pertaining to a fifth aspect of the present invention is the controller pertaining to any of the second aspect to the fourth aspect and further comprises a transceiver unit and a logic updater. The transceiver unit is connected to a network, transmits operating state data of the humidity control apparatus or the air conditioner to a remotely located network center via the network, and receives an optimal power consumption minimizing logic that is updated in such a way as to become more optimal on the basis of the operating state data. The logic updater updates the power consumption minimizing logic to the optimal power consumption minimizing logic that the transceiver unit receives.

For example, in a case where correction is frequently performed with respect to the power consumption minimizing logic according to the above described fourth aspect, there are cases where it takes time until the controller minimizes the power consumption and efficiency becomes worse. In a case where correction is frequently performed with respect the power consumption minimizing logic in this way, the controller downloads the optimal power consumption minimizing logic that is created by the network center and suited to the installation conditions of the humidity control apparatus and updates the power consumption minimizing logic stored in the storage unit to the optimal power consumption minimizing logic. The network center collects the operating state of the humidity control apparatus and the air conditioner and creates a power consumption minimizing logic suited to the installed humidity control apparatus and air conditioner as the optimal power consumption minimizing logic.

Consequently, the controller can utilize the power consumption minimizing logic suited to the humidity control apparatus and air conditioner installed in that location and can precisely perform the optimal target value setting processing.

A controller pertaining to a sixth aspect of the present invention is the controller pertaining to the fifth aspect, wherein the transceiver unit further receives weather forecast information. The target value setting processor employs the received weather forecast information as the outside air temperature and the outside air humidity among the operating conditions to set the target operating frequency and the target evaporation temperature.

For this reason, for example, on start-up or in a case where a certain amount of time is required until the system stabilizes after control values is changed, the controller can forecast an accurate outside air temperature. Thus, the controller can perform the optimal target value setting processing quickly and precisely.

A controller pertaining to a seventh aspect of the present invention is the controller pertaining to any of the first aspect to the sixth aspect, wherein the operation control unit controls the humidity controlling compressor to achieve the target operating frequency or less and controls the air conditioning compressor and/or the air conditioning expansion mechanism to achieve the target evaporation temperature or less.

In this way, the target operating frequency and the target evaporation temperature are not directly set as fixed values, so the state can be made automatically controllable when the latent heat load or the sensible heat load fluctuates in a short amount of time. For example, in a case where the latent heat load decreases in a short amount of time, the controller can control the latent heat throughput processed by the humidity control apparatus and can reduce the power consumption resulting from excess processing by lowering the operating frequency of the humidity control apparatus in accordance with the decreased latent heat load. Further, for example, in a case where the number of room occupants suddenly increases and the sensible heat load suddenly increases due to a change in the set temperature by a remote controller or the like, the controller can increase the sensible heat throughput processed by the air conditioner and eliminate a deficiency in performance by lowering the target evaporation temperature.

A controller pertaining to an eighth aspect of the present invention is the controller pertaining to the first aspect to the seventh aspect and further comprises a latent heat processing efficiency determiner. The latent heat processing efficiency determiner determines whether or not the latent heat processing efficiency in the humidity control apparatus falls. The target value setting processor does not perform the optimal target value setting processing in a case where it is determined that the latent heat processing efficiency in the humidity control apparatus falls.

The humidity control apparatus has the two adsorption heat exchangers and periodically switches between adsorption processing that adsorbs moisture from the outside air and regeneration processing that uses inlet air from the predetermined space to evaporate the moisture adsorbed by the adsorption heat exchangers (batch switching). Consequently, in a case where the latent heat generated in the predetermined space is large, the efficiency of the regeneration processing falls and the latent heat processing by the humidity control apparatus falls.

According to the controller pertaining to the eighth aspect, the controller does not perform the optimal target value setting processing in a case where the latent heat processing efficiency in the humidity control apparatus falls, on the controller can stabilize the air conditioning processing by the humidity control apparatus and the air conditioner and can prevent a drop in efficiency caused by continuing the optimal target value setting processing.

A controller pertaining to a ninth aspect of the present invention is the controller pertaining to the eighth aspect, wherein the latent heat processing efficiency determiner determines that the latent heat processing efficiency in the humidity control apparatus falls in a case where a value obtained by dividing the difference between an absolute humidity of the outside air and an absolute humidity of outlet air blown out into the predetermined space from the humidity control apparatus by the difference between the absolute humidity of the outside air and an absolute humidity of the predetermined space exceeds a predetermined value.

According to the controller pertaining to the ninth aspect, the controller determines a drop in the latent heat processing efficiency in the humidity control apparatus according to whether or not the value found by the absolute humidity of the outside air, the absolute humidity of the outlet air blown out into the predetermined space from the humidity control apparatus, and the absolute humidity of the predetermined space exceeds the predetermined value. Additionally, the controller does not perform the optimal target value setting processing in a case where the latent heat processing efficiency in the humidity control apparatus falls, so the controller can stabilize the air conditioning processing by the humidity control apparatus and the air conditioner and can prevent a drop in efficiency caused by continuing the optimal target value setting processing.

An air conditioning processing system pertaining to a tenth aspect of the present invention comprises a humidity control apparatus, an air conditioner, and a controller. The humidity control apparatus has a humidity controlling refrigerant circuit and performs humidity control processing of a predetermined space. The humidity controlling refrigerant circuit comprises the interconnection of a humidity controlling compressor, a first adsorption heat exchanger, a second adsorption heat exchanger, a humidity controlling expansion mechanism, and a switching mechanism. The switching mechanism is capable of switching between a first switched state and a second switched state. The first switched state is a state that allows refrigerant discharged from the humidity controlling compressor to circulate in the order of the first adsorption heat exchanger, the humidity controlling expansion mechanism, and the second adsorption heat exchanger. The second switched state is a state that allows the refrigerant discharged from the humidity controlling compressor to circulate in the order of the second adsorption heat exchanger, the humidity controlling expansion mechanism, and the first adsorption heat exchanger. The air conditioner has an air conditioning refrigerant circuit and performs air conditioning processing of the predetermined space. The air conditioning refrigerant circuit comprises the interconnection of at least an air conditioning compressor, a heat source-side heat exchanger, a utilization-side heat exchanger, and an air conditioning expansion mechanism. The controller has a power consumption detector, a target value setting processor, and an operation control unit. The power consumption detector detects a power consumption of the humidity control apparatus and the air conditioner. The target value setting processor performs optimal target value setting processing by performing first processing or second processing. The first processing is processing that lowers a target operating frequency of the humidity controlling compressor and lowers a target evaporation temperature in the utilization-side heat exchanger. The second processing is processing that raises the target operating frequency and raises the target evaporation temperature. The optimal target value setting processing is processing that sets the target operating frequency and the target evaporation temperature in such a way as to minimize the power consumption. The operation control unit controls the humidity controlling compressor to achieve the target operating frequency and controls the air conditioning compressor and/or the air conditioning expansion mechanism to achieve the target evaporation temperature.

According to the air conditioning processing system pertaining to the tenth aspect, the controller can optimally control the balance between the latent heat throughput processed by the humidity control apparatus and the latent heat throughput processed by the air conditioner and the balance between the sensible heat throughput processed by the humidity control apparatus and the sensible heat throughput processed by the air conditioner in such a way as to minimize the total power consumption by performing the first processing or the second processing. By performing the first processing, the controller can make the air conditioner process part of the latent heat load to be processed by the humidity control apparatus, and by performing the second processing, the controller can make the humidity control apparatus process part of the latent heat load to be processed by the air conditioner. For this reason, the controller can suppress the power consumption consumed by the humidity control apparatus and the air conditioner.

Further, in regard to the sensible heat throughput of the entire space, even if the sensible heat throughput processed by the humidity control apparatus increases or decreases, the air conditioner can perform sensible heat processing in accordance with the residual sensible heat throughput since the controller controls the target evaporation temperature of the utilization-side heat exchanger. For this reason, the temperature of the predetermined space can be easily maintained at the target temperature.

Advantageous Effects of Invention

The controller pertaining to the first aspect of the present invention can suppress the power consumption consumed by the humidity control apparatus and the air conditioner. Further, in regard to the sensible heat throughput of the entire space, even if the sensible heat throughput processed by the humidity control apparatus increases or decreases, the air conditioner can perform sensible heat processing in accordance with the residual sensible heat throughput since the controller controls the target evaporation temperature of the utilization-side heat exchanger. For this reason, the temperature of the predetermined space can be easily maintained at the target temperature.

The controller pertaining to the second aspect of the present invention can shorten the amount of time until it minimizes the power consumption consumed by the humidity control apparatus and the air conditioner.

The controller pertaining to the third aspect of the present invention can shorten the amount of time until it minimizes the power consumption consumed by the humidity control apparatus and the air conditioner.

In the controller pertaining to the fourth aspect of the present invention, even if an excess or deficiency in the latent heat throughput were to arise with respect to the latent heat load, the controller can revise the control state in such a way that the humidity of the predetermined space reliably reach the target humidity by controlling the target operating frequency of the humidity controlling compressor.

The controller pertaining to the fifth aspect of the present invention can utilize the power consumption minimizing logic suited to the humidity control apparatus and air conditioner installed in that location and can precisely perform the optimal target value setting processing.

In the controller pertaining to the sixth aspect of the present invention, for example, on start-up or in a case where a certain amount of time is required until the system stabilizes after control values is changed, the controller can forecast an accurate outside air temperature. Thus, the controller can perform the optimal target value setting processing quickly and precisely.

In the controller pertaining to the seventh aspect of the present invention, the target operating frequency and the target evaporation temperature are not directly set as fixed values, so the state can be made automatically controllable when the latent heat load or the sensible heat load fluctuates in a short amount of time. For example, in a case where the latent heat load decreases in a short amount of time, the controller can control the latent heat throughput processed by the humidity control apparatus and can reduce power consumption resulting from excess processing by lowering the operating frequency of the humidity control apparatus in accordance with the decreased latent heat load. Further, for example, in a case where the number of room occupants suddenly increases and the sensible heat load suddenly increases due to a change in the set temperature by a remote controller or the like, the controller can increase the sensible heat throughput processed by the air conditioner and eliminate a deficiency in performance by lowering the target evaporation temperature.

The controller pertaining to the eighth aspect of the present invention does not perform the optimal target value setting processing in a case where the latent heat processing efficiency in the humidity control apparatus falls, so the controller can stabilize the air conditioning processing by the humidity control apparatus and the air conditioner and can prevent a drop in efficiency caused by continuing the optimal target value setting processing.

The controller pertaining to the ninth aspect of the present invention does not perform the optimal target value setting processing in a case where the latent heat processing efficiency in the humidity control apparatus falls, so the controller can stabilize the air conditioning processing by the humidity control apparatus and the air conditioner and can prevent a drop in efficiency caused by continuing the optimal target value setting processing.

The air conditioning processing system pertaining to the tenth aspect of the present invention can suppress the power consumption consumed by the humidity control apparatus and the air conditioner. Further, in regard to the sensible heat throughput of the entire space, even if the sensible heat throughput processed by the humidity control apparatus increases or decreases, the air conditioner can perform sensible heat processing in accordance with the residual sensible heat throughput since the controller controls the target evaporation temperature of the utilization-side heat exchanger. For this reason, the temperature of the predetermined space can be easily maintained at the target temperature.

DESCRIPTION OF EMBODIMENT (1) Overall Configuration

Figure 1:
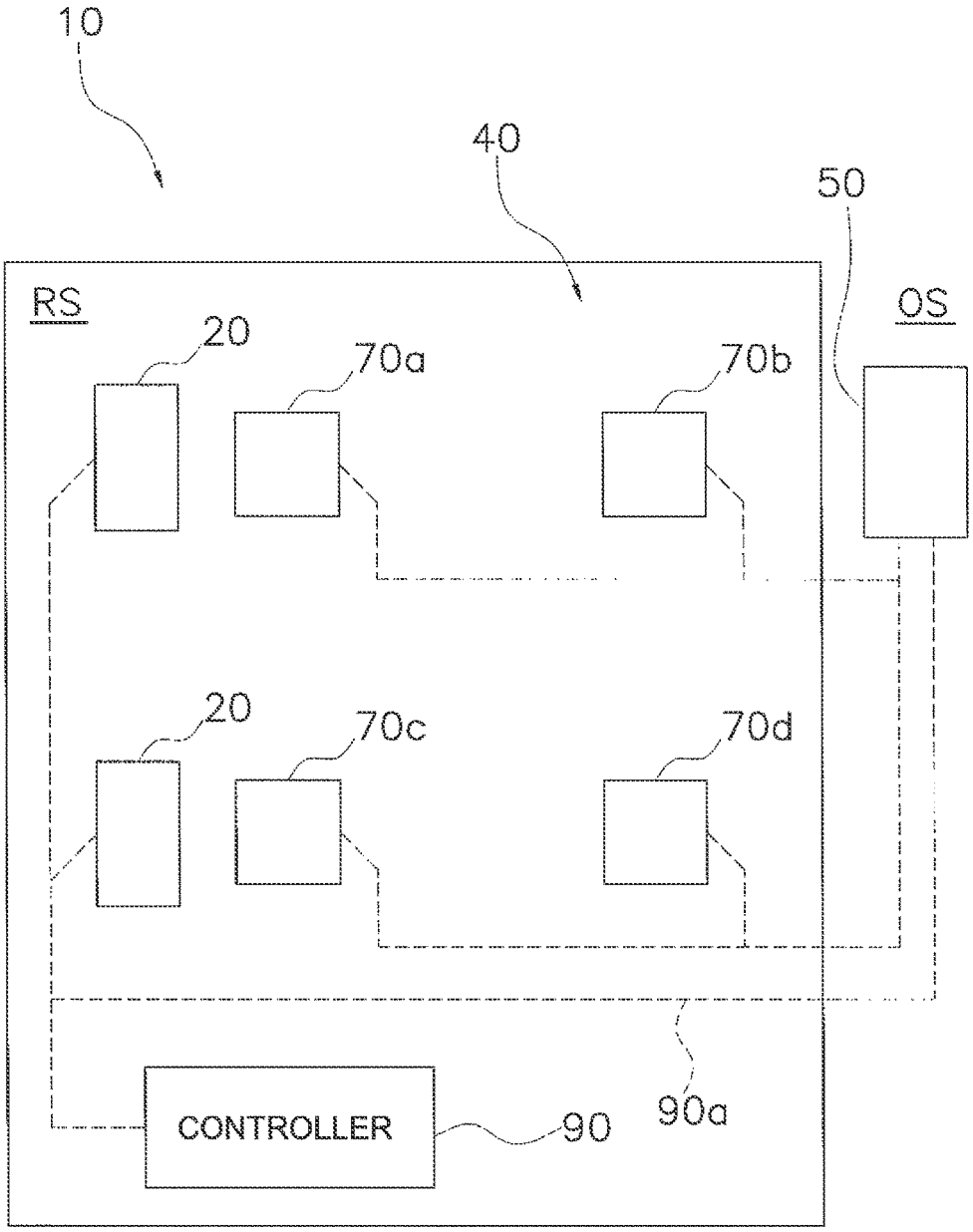
FIG. 1 is a schematic configuration diagram of an air conditioning processing system 10 pertaining to an embodiment of the present invention.

FIG. 1 is a schematic configuration diagram of an air conditioning processing system 10 pertaining to an embodiment of the present invention. The air conditioning processing system 10 is configured from a humidity control apparatus 20 that mainly performs latent heat processing of a room space, an air conditioner 40 that mainly performs sensible heat processing of the room space, and a controller 90 that is connected to the humidity control apparatus 20 and the air conditioner 40 by a control line 90*a* and controls the operations of the humidity control apparatus 20 and the air conditioner 40. The humidity control apparatus 20 and the air conditioner 40 are placed in a room space RS of a building or the like and perform air conditioning processing.

(2) Humidity Control Apparatus (2-1) Configuration of Humidity Control Apparatus The humidity control apparatus 20 will be described using FIGS. 2 to 5.

The humidity control apparatus 20 is configured by a humidity controlling refrigerant circuit 21, an exhaust air fan 31 that exhausts the room air of the room space RS to the outside after humidity control processing, and a supply air fan 32 that supplies outside air to the room space RS after humidity control processing. A first switching mechanism 27, a second switching mechanism 28, a third switching mechanism 29, and a fourth switching mechanism 30 are disposed in the humidity control apparatus 20. The first switching mechanism 27 is disposed on the upwind side of a second adsorption heat exchanger 23 and is capable of switching between being in communication with the outside air to perform heat exchange with the outside air and being in communication with the room space RS to perform heat exchange with the room air. The second switching mechanism 28 is disposed on the downwind side of the second adsorption heat exchanger 23 and is capable of switching between being in communication with the outside air to exhaust air after heat exchange and being in communication with the room space RS to supply air after heat exchange to the room. The third switching mechanism 29 is disposed on the upwind side of a first adsorption heat exchanger 22 and is capable of switching between being in communication with the outside air to perform heat exchange with the outside air and being in communication with the room space RS to perform heat exchange with the air in the room. The fourth switching mechanism 30 is disposed on the downwind side of the first adsorption heat exchanger 22 and is capable of switching between being in communication with the outside air to exhaust air after heat exchange and being in communication with the room space RS to supply air after heat exchange to the room.

The first adsorption heat exchanger 22, the second adsorption heat exchanger 23, a humidity controlling compressor 24, a humidity controlling four-way switching valve 25, and a humidity controlling electrically-powered expansion valve 26 are connected to the humidity controlling refrigerant circuit 21. The humidity controlling refrigerant circuit 21 performs a vapor compression refrigeration cycle by circulating the charged refrigerant. In the humidity controlling refrigerant circuit 21, the discharge side of the humidity controlling compressor 24 is connected to a first port of the humidity controlling four-way switching valve 25, and the suction side of the humidity controlling compressor 24 is connected to a second port of the humidity controlling four-way switching valve 25. One end of the first adsorption heat exchanger 22 is connected to a third port of the humidity controlling four-way switching valve 25. The other end of the first adsorption heat exchanger 22 is connected to one end of the second adsorption heat exchanger 23 via the humidity controlling electrically-powered expansion valve 26. The other end of the second adsorption heat exchanger 23 is connected to a fourth port of the humidity controlling four-way switching valve 25.

The humidity controlling four-way switching valve 25 is capable of switching between a first state (the state shown in FIGS. 2 and 4), in which the first port and the third port are in communication with one another and the second port and the fourth port are in communication with one another, and a second state (the state shown in FIGS. 3 and 5), in which the first port and the fourth port are in communication with one another and the second port and the third port are in communication with one another.

The first adsorption heat exchanger 22 and the second adsorption heat exchanger 23 are both configured by cross fin type fin-and-tube heat exchangers. These adsorption heat exchangers 22 and 23 are equipped with copper heat transfer tubes not shown in the drawings) and aluminum fins (not shown in the drawings).

In each of the adsorption heat exchangers 22 and 23, an adsorbent is carried on the surface of each of the fins, and air passing between the fins comes into contact with the adsorbent carried on the fins. As this adsorbent, an adsorbent that can adsorb airborne water vapor—such as a zeolite, a silica gel, an activated carbon, and an organic polymer material having a hydrophilic functional group—is used. The first adsorbent heat exchanger 22 and the second adsorbent heat exchanger 23 configure a humidity controlling member.

Further, various sensors are disposed in the humidity control apparatus 20. On the outdoor air inlet side of the humidity control apparatus 20, there are disposed an outside air temperature sensor 33 that detects the temperature of outdoor air OA (that is, an outside air temperature Toa) and an outside air humidity sensor 34 that detects the humidity of the outdoor air OA (that is, an outside air humidity Hoa). On the room air inlet side of the humidity control apparatus 20, there are disposed a room temperature sensor 35 that detects the temperature of room air RA (that is, a room temperature Tra) and a room humidity sensor 36 that detects the humidity of the room air RA (that is, a room humidity Hra). In the present embodiment, the outside air temperature sensor 33 and the room temperature sensor 35 comprise thermistors. Further, the humidity control apparatus 20 has a humidity controlling control unit 37 that controls the action of each part configuring the humidity control apparatus 20. The humidity controlling control unit 37 has a microcomputer which is disposed for controlling the humidity control apparatus 20, a memory and the like and can exchange control signals and so forth with a remote controller (not shown in the drawings) for individually operating the humidity control apparatus 20. Further, the humidity controlling control unit 37 calculates the temperature of supply air SA (that is, a supply air temperature Tsa) supplied to the room space RS from the humidity control apparatus 20 and the humidity of the supply air SA (that is, a supply air humidity Hsa) on the basis of the detected outside air temperature Toa, outside air humidity Hoa, room temperature Tra, and room humidity Hra. The outside air humidity Hoa and the room humidity Hra that are detected and the supply air humidity Hsa that is calculated are absolute humidities.

(2-2) Action of Humidity Control Apparatus

The humidity control apparatus 20 of the present embodiment performs a dehumidifying operation and a humidifying operation During the dehumidifying operation and the humidifying operation, the humidity control apparatus 20 controls the humidity of the in-taken outdoor air OA, supplies the outdoor air OA to the room as the supply air SA, and at the same time exhausts the in-taken room air RA to the outside as exhaust air EA.

(2-2-1) Dehumidifying Operation

In the humidity control apparatus 20 during the dehumidifying operation, a later-described first action and second action are alternated between one another at predetermined time intervals (for example, 3-minute intervals).

Figure 2:
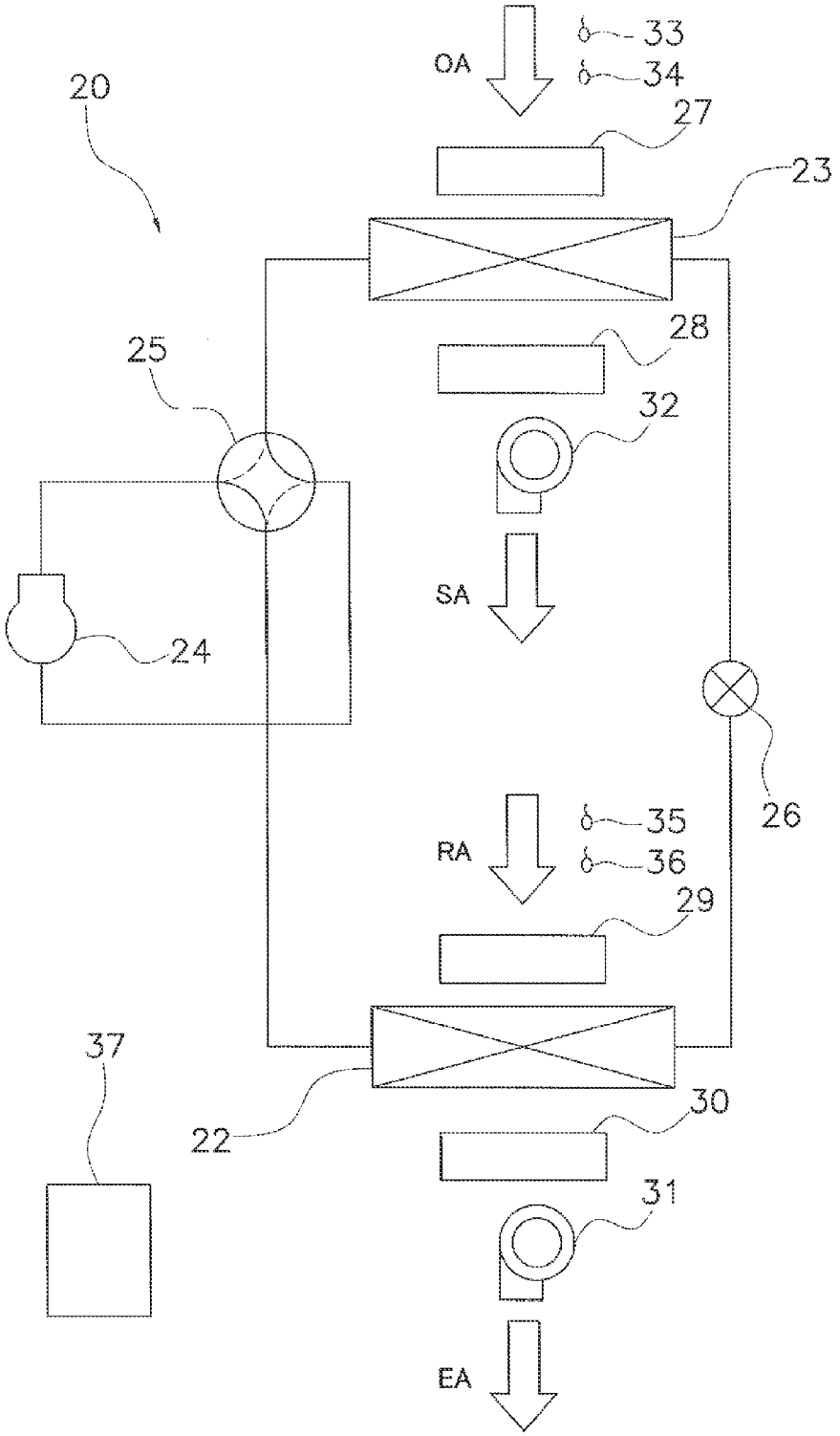
FIG. 2 is a schematic diagram showing a flow of air and the state of a refrigerant circuit in a first action of a dehumidifying operation of a humidity control apparatus.

First, the first action of the dehumidifying operation will be described. As shown in FIG. 2, during this first action, the first switching mechanism 27 places an outdoor space OS and the second adsorption heat exchanger 23 in a communicated state, the second switching mechanism 28 places the room space RS and the second adsorption heat exchanger 23 in a communicated state, the third switching mechanism 29 places the room space RS and the first adsorption heat exchanger 22 in a communicated state, and the fourth switching mechanism 30 places the outdoor space OS and the first adsorption heat exchanger 22 in a communicated state. The supply air fan 32 and the exhaust air fan 31 of the humidity control apparatus 20 are operated in this state. When the supply air fan 32 is operated, the outdoor air passes through the second adsorption heat exchanger 23 and is supplied to the room space RS as first air. When the exhaust air fan 31 is operated, the room air passes through the first adsorption heat exchanger 22 and is exhausted to the outdoor space OS as second air. The path along which the second air passes through the first adsorption heat exchanger 22 and the path along which the first air passes through the second adsorption heat exchanger 23 do not cross. This is not limited to the first action of the dehumidifying operation. The "first air" here is air that is supplied from the outdoor space OS to the room space RS through the inside of the humidity control apparatus 20 and the "second air" is air that is exhausted from the room space RS to the outdoor space OS through the inside of the humidity control apparatus 20.

In the humidity controlling refrigerant circuit 21 during this first action, as shown in FIG. 2, the humidity controlling four-way switching valve 25 is set to the first state. In the humidity controlling refrigerant circuit 21 in this state, the refrigerant circulates and the refrigeration cycle is performed. At that time, in the humidity controlling refrigerant circuit 21, the refrigerant discharged from the humidity controlling compressor 24 passes through in the order of the first adsorption heat exchanger 22, the humidity controlling electrically-powered expansion valve 26, and the second adsorption heat exchanger 23, with the first adsorption heat exchanger 22 working as a condenser and the second adsorption heat exchanger 23 working as an evaporator.

The first air travels through the first switching mechanism 27 and passes through the second adsorption heat exchanger 23. In the second adsorption heat exchanger 23, moisture in the first air is adsorbed by the adsorbent and the adsorption heat generated at that time is absorbed by the refrigerant. The first air dehumidified in the second adsorption heat exchanger 23 travels through the second switching mechanism 28 and is supplied to the room space RS by the supply air fan 32.

The second air travels through the third switching mechanism 29 and passes through the first adsorption heat exchanger 22. In the first adsorption heat exchanger 22, moisture desorbs from the adsorbent heated by the refrigerant, and this desorbed moisture is imparted to the second air. The second air to which the moisture has been imparted in the first adsorption heat exchanger 22 travels through the fourth switching mechanism 30 and is exhausted to the outdoor space OS by the exhaust air fan 31.

Figure 3:
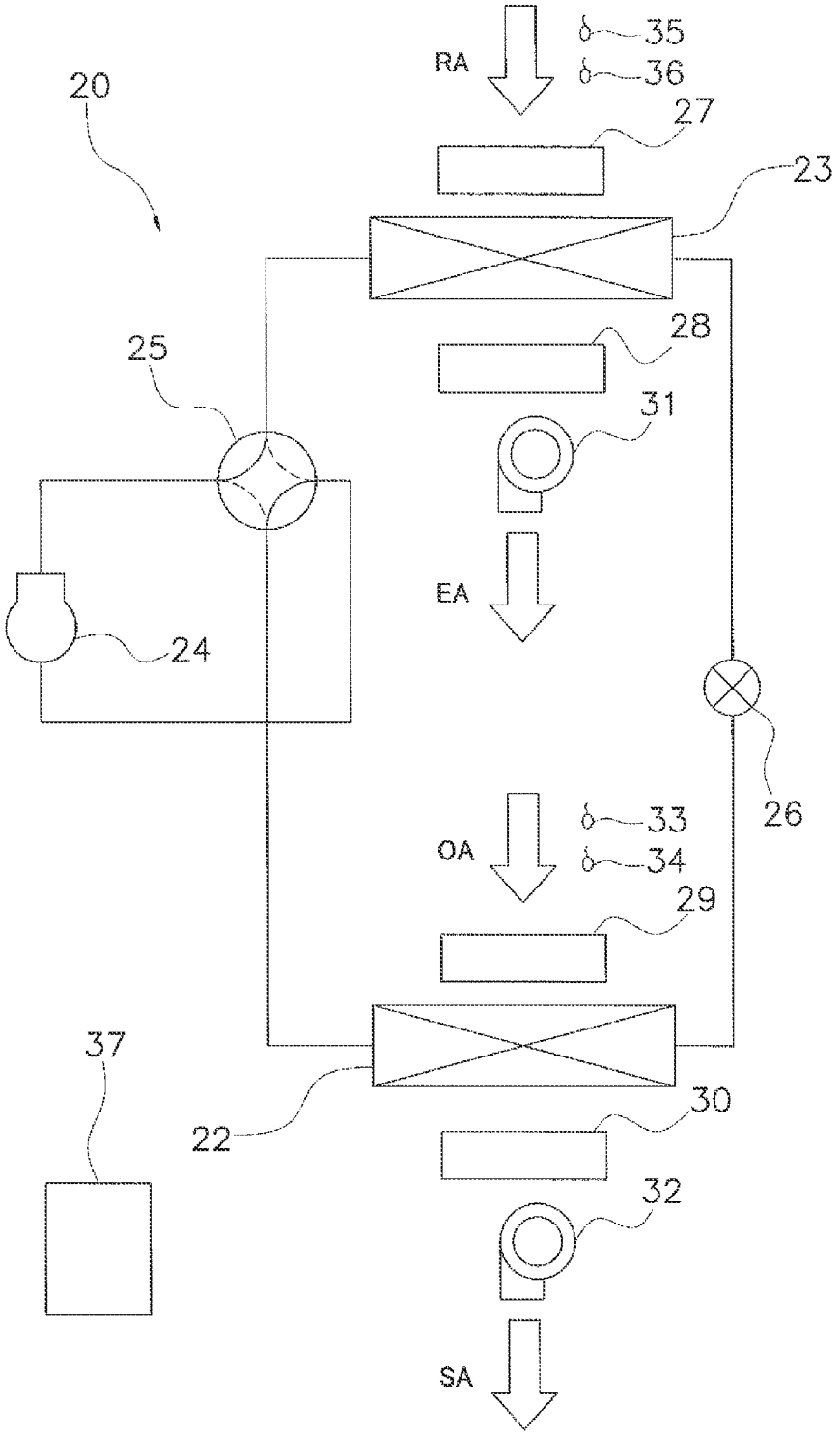
FIG. 3 is a schematic diagram showing a flow of air and the state of the refrigerant circuit in a second action of the dehumidifying operation of the humidity control apparatus.

The second action of the dehumidifying operation will be described. As shown in FIG. 3, during this second action, the first switching mechanism 27 places the room space RS and the second adsorption heat exchanger 23 in a communicated state, the second switching mechanism 28 places the outdoor space OS and the second adsorption heat exchanger 23 in a communicated state, the third switching mechanism 29 places the outdoor space OS and the first adsorption heat exchanger in a communicated state, and the fourth switching mechanism places the room space RS and the first adsorption heat exchanger in a communicated state. The supply air fan 32 and the exhaust air fan 31 of the humidity control apparatus 20 are operated in this state. When the supply air fan 32 is operated, the outdoor air passes through the first adsorption heat exchanger 22 and is supplied to the room space RS as the first air. When the exhaust air fan 31 is operated, the room air passes through the second adsorption heat exchanger 23 and is exhausted to the outdoor space OS as the second air.

In the humidity controlling refrigerant circuit 21 during this second action, as shown in FIG. 3, the humidity controlling four-way switching valve 25 is set to the second state. In the humidity controlling refrigerant circuit 21 in this state, the refrigerant circulates and the refrigeration cycle is performed. At that time, in the humidity controlling refrigerant circuit 21, the refrigerant discharged from the humidity controlling compressor 24 passes through in the order of the second adsorption heat exchanger 23, the humidity controlling electrically-powered expansion valve 26, and the first adsorption heat exchanger 22, with the first adsorption heat exchanger 22 working as an evaporator and the second adsorption heat exchanger 23 working as a condenser.

The first air travels through the third switching mechanism 29 and passes through the first adsorption heat exchanger 22. In the first adsorption heat exchanger 22, moisture in the first air is adsorbed by the adsorbent, and the adsorption heat generated at that time is absorbed by the refrigerant. The first air dehumidified in the first adsorption heat exchanger 22 travels through the fourth switching mechanism 30 and is supplied to the room space RS by the supply air fan 32.

The second air travels through the first switching mechanism 27 and passes through the second adsorption heat exchanger 23. In the second adsorption heat exchanger 23, moisture desorbs from the adsorbent heated by the refrigerant, and this desorbed moisture is imparted to the second air. The second air to which the moisture has been imparted in the second adsorption heat exchanger 23 travels through the second switching mechanism 28 and is exhausted to the outdoor space OS by the exhaust air fan 31.

(2-2-2) Humidifying Operation

In the humidity control apparatus 20 during the humidifying operation, a later-described first action and second action are alternated between one another at predetermined time intervals (for example, 3-minute intervals).

Figure 4:
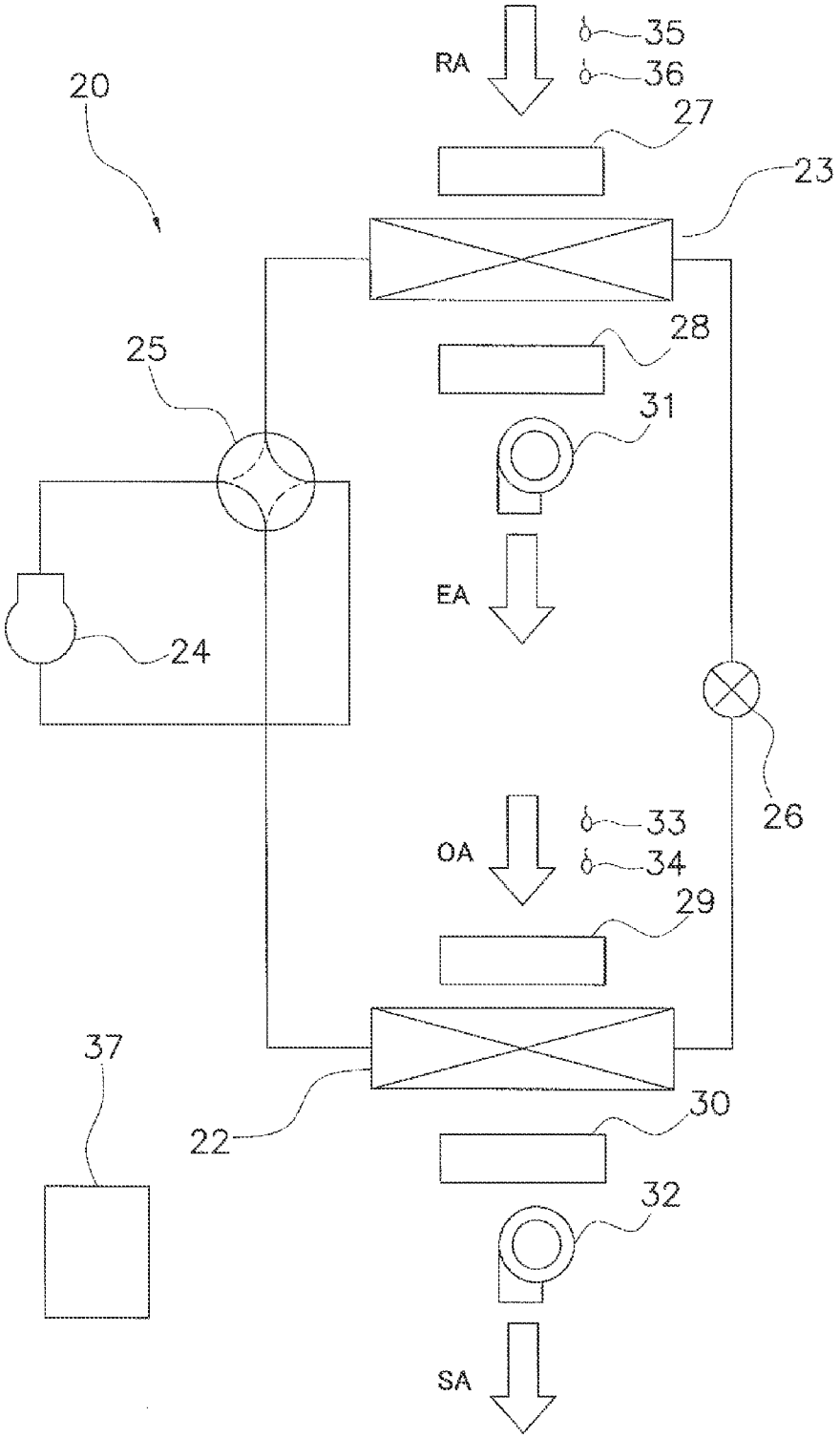
FIG. 4 is a schematic diagram showing a flow of air and the state of the refrigerant circuit in a first action of a humidifying operation of the humidity control apparatus.

First, the first action of the humidifying operation will be described. As shown in FIG. 4, during this first action, the first switching mechanism 27 places the room space RS and the second adsorption heat exchanger 23 in a communicated state, the second switching mechanism 28 places the outdoor space OS and the second adsorption heat exchanger 23 in a communicated state, the third switching mechanism 29 places the outdoor space OS and the first adsorption heat exchanger 22 in a communicated state, and the fourth switching mechanism places the room space RS and the first adsorption heat exchanger 22 in a communicated state. The supply air fan 32 and the exhaust air fan 31 of the humidity control apparatus 20 are operated in this state. When the supply air fan 32 is operated, the outdoor air passes through the first adsorption heat exchanger 22 and is supplied to the room space RS as the first air. When the exhaust air fan 31 is operated, the room air passes through the second adsorption heat exchanger 23 and is exhausted to the outdoor space OS as the second air.

In the humidity controlling refrigerant circuit 21 during this first action, as shown in FIG. 4, the humidity controlling four-way switching valve 25 is set to the first state. In this humidity controlling refrigerant circuit 21, like during the first action of the dehumidifying operation, the first adsorption heat exchanger 22 works as a condenser and the second adsorption heat exchanger 23 works as an evaporator.

The first air travels through the third switching mechanism 29 and thereafter passes through the first adsorption heat exchanger 22. In the first adsorption heat exchanger 22, moisture desorbs from the adsorbent heated by the refrigerant, and this desorbed moisture is imparted to the first air. The first air humidified in the first adsorption heat exchanger 22 travels through the fourth switching mechanism 30 and is supplied to the room space RS by the supply air fan 32.

The second air travels through the first switching mechanism 27 and thereafter passes through the second adsorption heat exchanger 23. In the second adsorption heat exchanger 23, moisture in the second air is adsorbed by the adsorbent, and the adsorption heat generated at that time is absorbed by the refrigerant. The second air whose moisture has been taken away in the second adsorption heat exchanger 23 travels through the second switching mechanism 28 and is exhausted to the outdoor space OS by the exhaust air fan 31.

Figure 5:
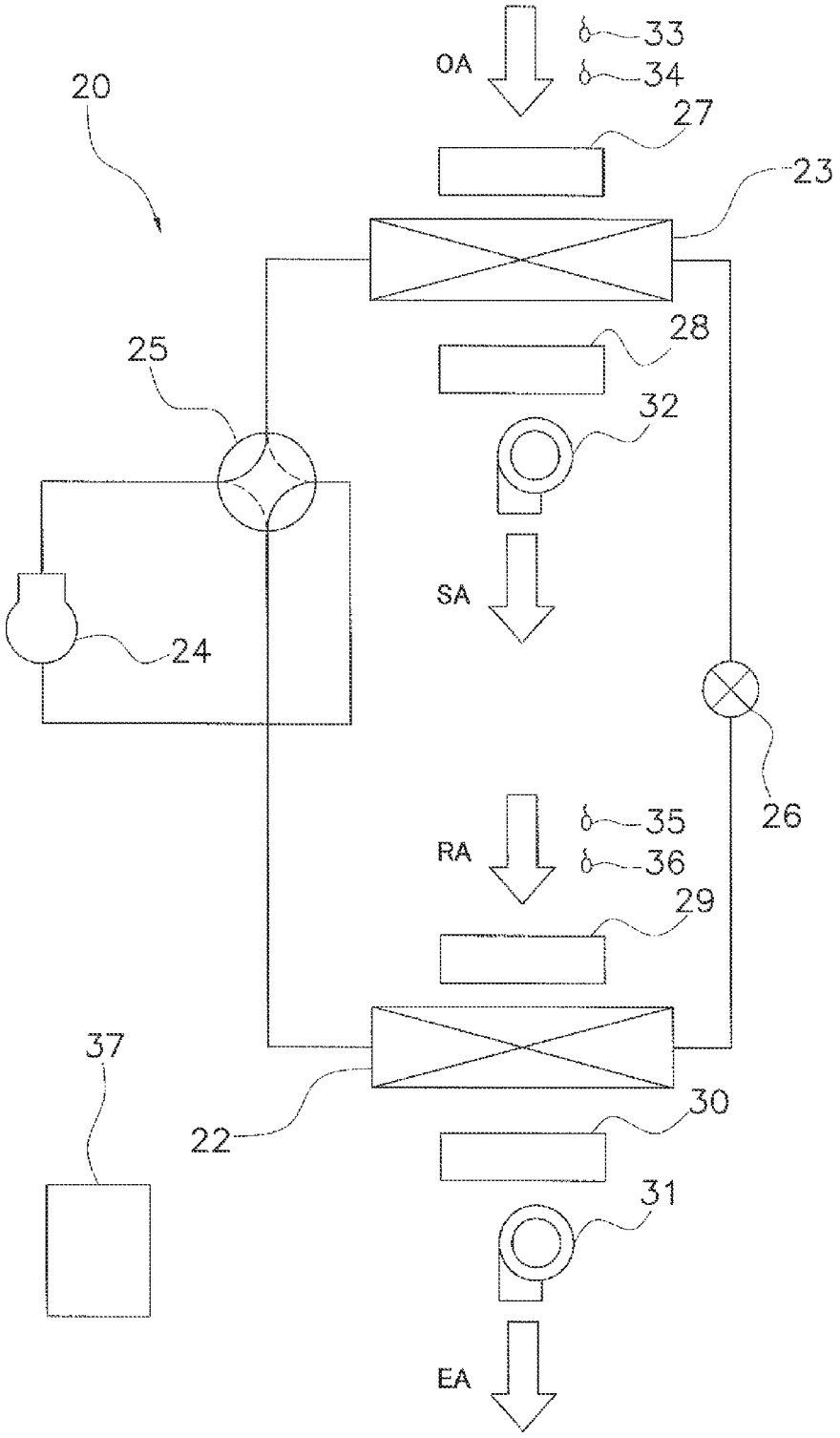
FIG. 5 is a schematic diagram showing a flow of air and the state of the refrigerant circuit in a second action of the humidifying operation of the humidity control apparatus.

The second action of the humidifying operation will be described. As shown in FIG. 5, during this second action, the first switching mechanism 27 places the outdoor space OS and the second adsorption heat exchanger 23 in a communicated state, the second switching mechanism 28 places the room space RS and the second adsorption heat exchanger 23 in a communicated state, the third switching mechanism 29 places the room space RS and the first adsorption heat exchanger 22 in a communicated state, and the fourth switching mechanism places the outdoor space OS and the first adsorption heat exchanger 22 in a communicated state. The supply air fan 32 and the exhaust air fan 31 of the humidity control apparatus 20 are operated in this state. When the supply air fan 32 is operated, the outside air passes through the second adsorption heat exchanger 23 and is supplied to the room space RS as the first air. When the exhaust air fan 31 is operated, the room air passes through the first adsorption heat exchanger 22 and is exhausted to the outdoor space OS as the second air.

In the humidity controlling refrigerant circuit 21 during this second action, as shown in FIG. 5, the humidity controlling four-way switching valve 25 is set to the second state. In this humidity controlling refrigerant circuit 21, like during the second action of the dehumidifying operation, the first adsorption heat exchanger 22 works as an evaporator and the second adsorption heat exchanger 23 works as a condenser.

The first air travels through the first switching mechanism 27 and passes through the second adsorption heat exchanger 23. In the second adsorption heat exchanger 23, moisture desorbs from the adsorbent heated by the refrigerant, and this desorbed moisture is imparted to the first air. The first air humidified in the second adsorption heat exchanger 23 travels through the second switching mechanism 28 and is supplied to the room space RS by the supply air fan 32.

The second air travels through the third switching mechanism 29 and passes through the first adsorption heat exchanger 22. In the first adsorption heat exchanger 22, moisture in the second air is adsorbed by the adsorbent, and the adsorption heat generated at that time is absorbed by the refrigerant. The second air whose moisture has been taken away in the first adsorption heat exchanger 22 travels through the fourth switching mechanism 30, passes through the exhaust air fan 31, and is thereafter exhausted to the outdoor space OS.

(3) Air Conditioner (3-1) Configuration of Air Conditioner

Figure 6:
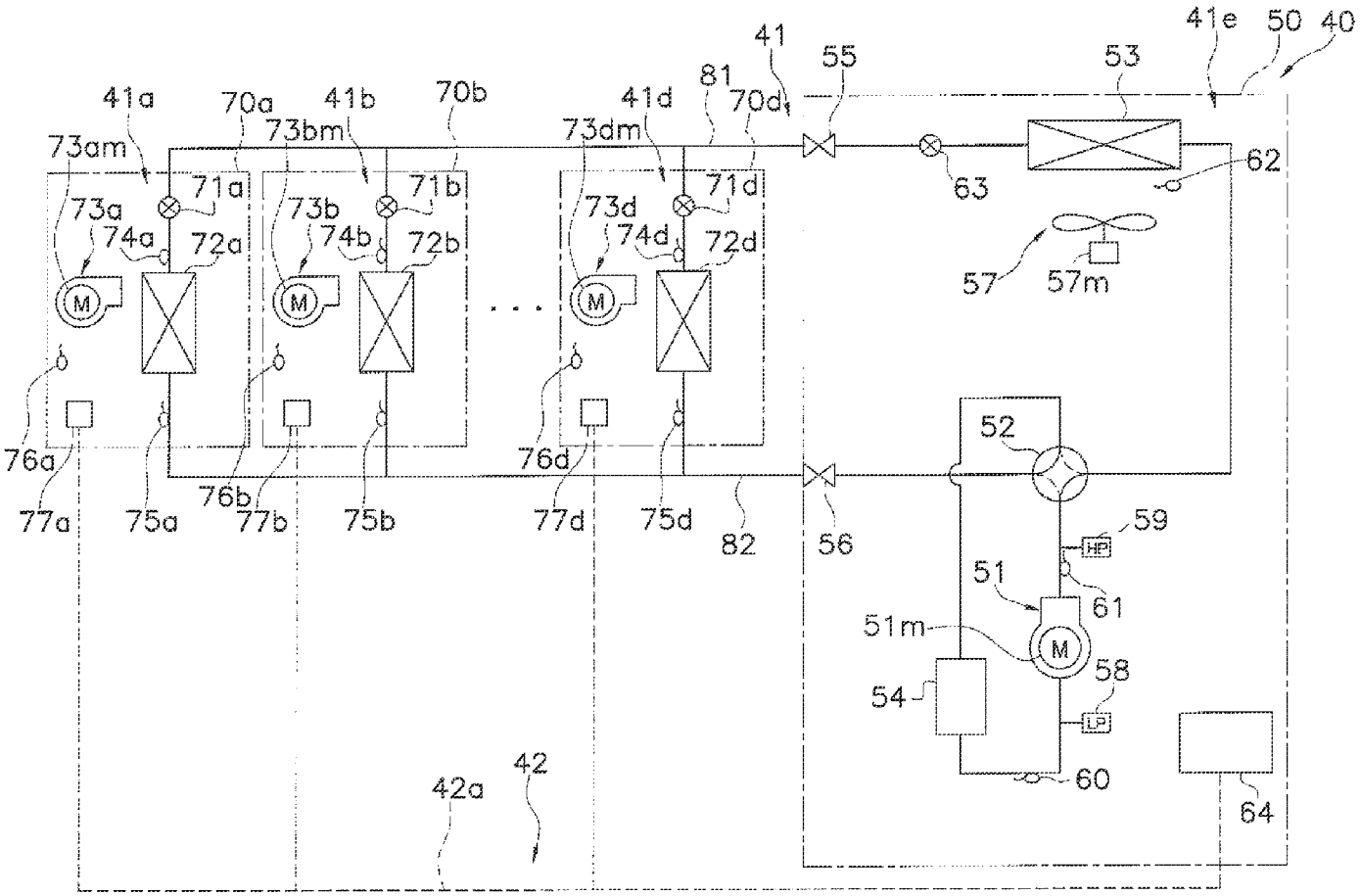
FIG. 6 is a schematic configuration diagram of an air conditioner.

FIG. 6 is a schematic configuration diagram of the air conditioner 40. The air conditioner 40 is an apparatus used to cool and heat the room space RS by performing a vapor compression refrigeration cycle operation. The air conditioner 40 is mainly equipped with an outdoor unit 50 that serves as one heat source unit, indoor units 70*a* to 70*d* that serve as plural (in the present embodiment, four) utilization units connected in parallel to the outdoor unit 50, and a liquid refrigerant connection tube 81 and a gas refrigerant connection tube 82 that serve as refrigerant connection tubes interconnecting the outdoor unit 50 and the indoor units 70*a* to 70*d*. That is, an air conditioning refrigerant circuit 41 of the air conditioner 40 of the present embodiment, which is a vapor compression refrigerant circuit, is configured as a result of the outdoor unit 50, the indoor units 70*a* to 70*d*, and the liquid refrigerant connection tube 81 and the gas refrigerant connection tube 82 being connected.

(3-1-1) Indoor Units

The indoor units 70*a* to 70*d* are installed such as by being embedded in or suspended from a ceiling in a room of a building or the like or such as by being mounted on a wall surface in the room. The indoor units 70*a* to 70*d* are connected to the outdoor unit 50 via the liquid refrigerant connection tube 81 and the gas refrigerant connection tube 82 and configure part of the air conditioning refrigerant circuit 41.

Next, the configuration of the indoor units 70*a* to 70*d* will be described. Since the indoor unit 70*a* and the indoor units 70*b* to 70*d* have the same configuration, here only the configuration of the indoor unit 70*a* will be described. In regard to the configuration of the indoor units 70*b* to 70*d*, reference signs in the 70*b*'s, 70*c*'s, or 70*d*'s will be given instead of reference signs in the 70*a*'s indicating each part of the indoor unit 70*a*, and description of each part will be omitted.

The indoor unit 70*a* mainly has an indoor-side air conditioning refrigerant circuit 41*a* (in the indoor unit 70*b*, an indoor-side air conditioning refrigerant circuit 41*b*; in the indoor unit 70*c*, an indoor-side air conditioning refrigerant circuit 41*c*; and in the indoor unit 70*d*, an indoor-side air conditioning refrigerant circuit 41*d*) that configures part of the air conditioning refrigerant circuit 41. This indoor-side air conditioning refrigerant circuit 41*a* mainly has an indoor expansion valve 71*a*, which serves as an air conditioning expansion mechanism, and an indoor heat exchanger 72*a*, which serves as a utilization-side heat exchanger.

In the present embodiment, the indoor expansion valve 71*a* is an electrically-powered expansion valve that is connected to the liquid side of the indoor heat exchanger 72*a* in order to control the flow rate of the refrigerant flowing in the indoor-side air conditioning refrigerant circuit 41*a* and the like, and the indoor expansion valve 71*a* is also capable of cutting off the passage of the refrigerant.

In the present embodiment, the indoor heat exchanger 72*a* is a cross fin type fin-and-tube heat exchanger configured by heat transfer tubes and plural fins and is a heat exchanger that functions as an evaporator of the refrigerant to cool the room air at the time of a cooling operation and functions as a condenser of the refrigerant to heat the room air at the time of a heating operation. In the present embodiment, the indoor heat exchanger 72*a* is a cross fin type fin-and-tube heat exchanger, but the indoor heat exchanger 72*a* is not limited to this and may also be another type of heat exchanger.

In the present embodiment, the indoor unit 70*a* has an indoor fan 73*a* that serves as a blower for sucking room air into the unit, allowing the air to exchange heat with the refrigerant in the indoor heat exchanger 72*a*, and thereafter supplying the air into the room as supply air. In the present embodiment, the indoor fan 73*a* is a centrifugal fan, a multi-blade fan, or the like, driven by a motor 73*am* comprising a DC fan motor or the like.

Further, various sensors are disposed in the indoor unit 70*a*. On the liquid side of the indoor heat exchanger 72*a*, there is disposed a liquid-side temperature sensor 74*a* that detects the temperature of the refrigerant (that is, the refrigerant temperature corresponding to a refrigerant temperature Tsc in a subcooled state at the time of the heating operation or the refrigerant temperature corresponding to an evaporation temperature Te at the time of the cooling operation). On the gas side of the indoor heat exchanger 72*a*, there is disposed a gas-side temperature sensor 75*a* that detects the temperature of the refrigerant. On the room air inlet side of the indoor unit 70*a*, there is disposed a room temperature sensor 76*a* that detects the temperature of the room air (that is, a room temperature Tr) flowing into the unit. In the present embodiment, the liquid-side temperature sensor 74*a*, the gas-side temperature sensor 75*a*, and the room temperature sensor 76*a* comprise thermistors. Further, the indoor unit 70*a* has an indoor-side control unit 77*a* that controls the action of each part configuring the indoor unit 70*a*. The indoor-side control unit 77*a* has a microcomputer which is disposed for controlling the indoor unit 70*a*, a memory and the like, can exchange control signals and so forth with a remote controller (not shown in the drawings) for individually operating the indoor unit 70*a*, and can exchange control signals and so forth with the outdoor unit 50 via a transmission line 42*a*.

(3-1-2) Outdoor Unit

The outdoor unit 50 is installed outside a building or the like, is connected to the indoor units 70*a* to 70*d* via the liquid refrigerant connection tube 81 and the gas refrigerant connection tube 82, and configures the air conditioning refrigerant circuit 41 together with the indoor units 70*a* to 70*d*.

Next, the configuration of the outdoor unit 50 will be described. The outdoor unit 50 mainly has an outdoor-side air conditioning refrigerant circuit 41*e* that configures part of the air conditioning refrigerant circuit 41. This outdoor-side air conditioning refrigerant circuit 41*e* mainly has an air conditioning compressor 51, an air conditioning four-way switching valve 52, an outdoor heat exchanger 53 that serves as a heat source-side heat exchanger, an outdoor expansion valve 63 that serves as an air conditioning expansion mechanism, an accumulator 54, a liquid-side shutoff valve 55, and a gas-side shutoff valve 56.

The air conditioning compressor 51 is a compressor whose operating capacity is capable of being varied and, in the present embodiment, is a positive-displacement compressor driven by a motor 51*m* whose speed is controlled by an inverter. In the present embodiment, the air conditioning compressor 51 comprises only one compressor, but it is not limited to this, and two or more compressors may also be connected in parallel in accordance with, for example, the number of indoor units that are connected.

The air conditioning four-way switching valve 52 is a valve for switching the direction of the flow of the refrigerant. At the time of the cooling operation, the air conditioning four-way switching valve 52 is capable of interconnecting the discharge side of the air conditioning compressor 51 and the gas side of the outdoor heat exchanger 53 and also interconnecting the suction side of the air conditioning compressor 51 (specifically, the accumulator 54) and the gas refrigerant connection tube 82 side in order to cause the outdoor heat exchanger 53 to function as a condenser of the refrigerant compressed by the air conditioning compressor 51 and to cause the indoor heat exchangers 72*a* to 72*d* to function as evaporators of the refrigerant condensed in the outdoor heat exchanger 53 (a cooling operation state: see the solid tines of the air conditioning four-way switching valve 52 in FIG. 6). At the time of the heating operation, the air conditioning four-way switching valve 52 is capable of interconnecting the discharge side of the air conditioning compressor 51 and the gas refrigerant connection tube 82 side and also interconnecting the suction side of the air conditioning compressor 51 and the gas side of the outdoor heat exchanger 53 in order to cause the indoor heat exchangers 72*a* to 72*d* to function as condensers of the refrigerant compressed by the air conditioning compressor 51 and to cause the outdoor heat exchanger 53 to function as an evaporator of the refrigerant condensed in the indoor heat exchangers 72*a* to 72*d* (a heating operation state: see the dashed tines of the air conditioning four-way switching valve 52 in FIG. 6).

In the present embodiment, the outdoor heat exchanger 53 is a cross fin type fin-and-tube heat exchanger and is a device for using air as a heat source to exchange heat with the refrigerant. The outdoor heat exchanger 53 is a heat exchanger that functions as a condenser of the refrigerant at the time of the cooling operation and functions as an evaporator of the refrigerant at the time of the heating operation. The gas side of the outdoor heat exchanger 53 is connected to the air conditioning four-way switching valve 52, and the liquid side of the outdoor heat exchanger 53 is connected to the outdoor expansion valve 63. In the present embodiment, the outdoor heat exchanger 53 is across fin type fin-and-tube heat exchanger, but the outdoor heat exchanger 53 is not limited to this and may also be another type of heat exchanger.

In the present embodiment, the outdoor expansion valve 63 is an electrically-powered expansion valve that is placed on the downstream side of the outdoor heat exchanger 53 (in the present embodiment, the outdoor expansion valve 63 is connected to the liquid side of the outdoor heat exchanger 53) in the flow direction of the refrigerant in the air conditioning refrigerant circuit 41 when performing the cooling operation and controls the pressure, flow rate and the like, of the refrigerant flowing in the outdoor-side air conditioning refrigerant circuit 41*e*. In the present embodiment, as the air conditioning expansion mechanism, the outdoor expansion valve 63 is disposed in the outdoor unit and the indoor expansion valves 71*a* to 71*d* are disposed in the indoor units 70*a* to 70*d* respectively, but the position of the air conditioning expansion mechanism is not limited to this. For instance, the air conditioning expansion mechanism may be disposed only in the outdoor unit 50 or may be disposed in a connection unit independent of the indoor units 70*a* to 70*d* and the outdoor unit 50.

In the present embodiment, the outdoor unit 50 has an outdoor fan 57 that serves as a blower for sucking outdoor air into the unit, allowing the air to exchange heat with the refrigerant in the outdoor heat exchanger 53, and thereafter exhausting the air to the outdoors. This outdoor fan 57 is a fan that is capable of varying the air volume of the air which is supplied to the outdoor heat exchanger 53; in the present embodiment, the outdoor fan 57 is a propeller fan or the like driven by a motor 57*m* comprising a DC fan motor or the like.

The liquid-side shutoff valve 55 and the gas-side shutoff valve 56 are valves disposed at the connecting ports to which external devices or tubes (specifically, the liquid refrigerant connection tube 81 and the gas refrigerant connection tube 82) are connected. The liquid-side shutoff valve 55 is placed on the downstream side of the outdoor expansion valve 63 and on the upstream side of the liquid refrigerant connection tube 81 in the flow direction of the refrigerant in the air conditioning refrigerant circuit 41 when performing the cooling operation and is capable of cutting off the passage of the refrigerant. The gas-side shutoff valve 56 is connected to the air conditioning four-way switching valve 52.

Further, various sensors are disposed in the outdoor unit 50. Specifically, a suction pressure sensor 58 that detects the suction pressure of the air conditioning compressor 51, a discharge pressure sensor 59 that detects the discharge pressure of the air conditioning compressor 51, a suction temperature sensor 60 that detects the suction temperature of the air conditioning compressor 51, and a discharge temperature sensor 61 that detects the discharge temperature of the air conditioning compressor 51 are disposed in the outdoor unit 50. On the outdoor air inlet side of the outdoor unit 50, there is disposed an outdoor temperature sensor 62 that detects the temperature of the outdoor air (that is, the outdoor temperature) flowing into the unit. In the present embodiment, the suction temperature sensor 60, the discharge temperature sensor 61, and the outdoor temperature sensor 62 comprise thermistors. Further, the outdoor unit 50 has an outdoor-side control unit 64 that controls the action of each part configuring the outdoor unit 50. The outdoor-side control unit 64 has a microcomputer that is disposed for controlling the outdoor unit 50, a memory, and an inverter circuit that controls the motor 51*m* and the like, and the outdoor-side control unit 64 can exchange control signals and so forth with the indoor-side control units 77*a* to 77*d* of the indoor units 70*a* to 70*d* via the transmission line 42*a*. That is, an air conditioning control unit 42 that controls the operation of the entire air conditioner 40 is configured by the indoor-side control units 77*a* to 77*d*, the outdoor-side control unit 64, and the transmission line 42*a* that interconnects the indoor-side control units 77*a* to 77*d* and the outdoor-side control unit 64.

The air conditioning control unit 42 is connected in such a way that it can receive the detection signals of the various sensors 58 to 62, 74*a* to 74*d*, 75*a* to 75*d*, and 76*a* to 76*d* and is connected in such a way that it can control the various devices and valves 51, 52, 57, 63, 71*a* to 71*d*, and 73*a* to 73*d* on the basis of these detection signals and so forth. Further, various data are stored in the memories configuring the air conditioning control unit 42.

(3-1-3) Refrigerant Connection Tubes

The refrigerant connection tubes 81 and 82 are refrigerant tubes constructed on-site when installing the air conditioner 40 in an installation location such as a building, and tubes having a variety of lengths and tube diameters are used in accordance with installation conditions such as the installation location and the combination of outdoor units and indoor units. For this reason, for example, in the case of newly installing the air conditioner, it is necessary to charge the air conditioner 40 with the proper quantity of refrigerant according to installation conditions such as the length and tube diameter of the refrigerant connection tubes 81 and 82.

As described above, the air conditioning refrigerant circuit 41 of the air conditioner 40 is configured as a result of the indoor-side air conditioning refrigerant circuits 41*a* to 41*d*, the outdoor-side air conditioning refrigerant circuit 41*e*, and the refrigerant connection tubes 81 and 82 being connected. In the air conditioner 40 of the present embodiment, the air conditioning control unit 42 configured from the indoor-side control units 77*a* to 77*d* and the outdoor-side control unit 64 uses the air conditioning four-way switching valve 52 to switch between the cooling operation and the heating operation to perform these operations and controls each device of the outdoor unit 50 and the indoor units 70*a* to 70*d* in accordance with the operating load of each of the indoor units 70*a* to 70*d*.

(3-2) Action of Air Conditioner

Next, the action of the air conditioner 40 of the present embodiment will be described.

In the cooling operation and the heating operation described below, the air conditioner 40 performs, for each of the indoor units 70*a* to 70*d*, room temperature optimizing control that brings the room temperature Tr closer to a set temperature Ts that the user sets with an input device such as a remote controller. In this room temperature optimizing control, the opening degree of each of the indoor expansion valves 71*a* to 71*d* is controlled in such a way that the room temperature Tr converges on the set temperature Ts. The "control of the opening degree of each of the indoor expansion valves 71*a* to 71*d*" here is controlling the degree of superheat in the outlet of each of the indoor heat exchangers 72*a* to 72*d* in the case of the cooling operation and controlling the degree of subcooling in the outlet of each of the indoor heat exchangers 72*a* to 72*d* in the case of the heating operation.

(3-2-1) Cooling Operation

First, the cooling operation will be described using FIG. 6.

At the time of the cooling operation, the air conditioning four-way switching valve 52 is in the state indicated by the solid lines in FIG. 6, that is, a state in which the discharge side of the air conditioning compressor 51 is connected to the gas side of the outdoor heat exchanger 53 and in which suction side of the air conditioning compressor 51 is connected to the gas sides of the indoor heat exchangers 72*a* to 72*d* via the gas-side shutoff valve 56 and the gas refrigerant connection tube 82. Here, the outdoor expansion valve 63 is placed in a fully open state. The liquid-side shutoff valve 55 and the gas-side shutoff valve 56 are placed in an open state. The opening degree of each indoor expansion valves 71*a* to 71*d* is controlled in such a way that a degree of superheat SH of the refrigerant at the outlets of the indoor heat exchangers 72*a* to 72*d* (that is, on the gas sides of the indoor heat exchangers 72*a* to 72*d*) becomes constant at a target degree of superheat SHt. The target degree of superheat SHt is set to an optimal temperature value in order for the room temperature Tr to converge on the set temperature Ts in a predetermined degree of superheat range. In the present embodiment, the degree of superheat SH of the refrigerant at the outlet of each of the indoor heat exchangers 72*a* to 72*d* is detected by subtracting the refrigerant temperature value (which corresponds to the evaporation temperature Te) detected by the liquid-side temperature sensors 74*a* to 74*d* from the refrigerant temperature value detected by the gas-side temperature sensors 75*a* to 75*d*. However, the degree of superheat SH of the refrigerant at the outlet of each of the indoor heat exchangers 72*a* to 72*d* is not limited to being detected by the above method and may also be detected by converting the suction pressure of the air conditioning compressor 51 detected by the suction pressure sensor 58 into the saturation temperature value corresponding to the evaporation temperature Te and subtracting this saturation temperature value of the refrigerant from the refrigerant temperature value detected by the gas-side temperature sensors 75*a* to 75*d*. Although it is not employed in the present embodiment, temperature sensors that detect the temperature of the refrigerant flowing in each of the indoor heat exchangers 72*a* to 72*d* may also be disposed, and the degree of superheat SH of the refrigerant at the outlet of each of the indoor heat exchangers 72*a* to 72*d* may also be detected by subtracting the refrigerant temperature value corresponding to the evaporation temperature Te detected by these temperature sensors from the refrigerant temperature value detected by the gas-side temperature sensors 75*a* to 75*d*.

When the air conditioning compressor 51, the outdoor fan 57, and the indoor fans 73*a* to 73*d* are operated in this state of the air conditioning refrigerant circuit 41, low-pressure gas refrigerant is sucked into the air conditioning compressor 51, compressed, and becomes high-pressure gas refrigerant. Thereafter, the high-pressure gas refrigerant is sent to the outdoor heat exchanger 53 via the air conditioning four-way switching valve 52, is condensed by heat exchange with the outdoor air supplied by the outdoor fan 57, and becomes high-pressure liquid refrigerant. Then, this high-pressure liquid refrigerant is sent to the indoor units 70*a* to 70*d* via the liquid-side shutoff valve 55 and the liquid refrigerant connection tube 81.

This high-pressure liquid refrigerant sent to the indoor units 70*a* to 70*d* is depressurized to near the suction pressure of the air conditioning compressor 51 by the indoor expansion valves 71*a* to 71*d*, becomes low-pressure refrigerant in a gas-liquid two-phase state, and is sent to the indoor heat exchangers 72*a* to 72*d*. Then, the refrigerant is evaporated by heat exchange with the room air in the indoor heat exchangers 72*a* to 72*d* and becomes low-pressure gas refrigerant.

This low-pressure gas refrigerant is sent to the outdoor unit 50 via the gas refrigerant connection tube 82 and flows into the accumulator 54 via the gas-side shutoff valve 56 and the air conditioning four-way switching valve 52. Then, the low-pressure gas refrigerant that has flowed into the accumulator 54 is sucked into the air conditioning compressor 51 again. In this way, the air conditioner 40 is capable of performing at least a cooling operation that causes the outdoor heat exchanger 53 to function as a condenser of the refrigerant compressed in the air conditioning compressor 51 and causes the indoor heat exchangers 72*a* to 72*d* to function as evaporators of the refrigerant sent through the liquid refrigerant connection tube 81 and the indoor expansion valves 71*a* to 71*d* after being condensed in the outdoor heat exchanger 53. The air conditioner 40 does not have mechanisms that control the pressure of the refrigerant on the gas sides of the indoor heat exchangers 72*a* to 72*d*, so an evaporation pressure Pe in all the indoor heat exchangers 72*a* to 72*d* becomes a common pressure.

(3-2-2) Heating Operation

Next, the heating operation will be described.

At the time of the heating operation, the air conditioning four-way switching valve 52 is in the state (heating operation state) indicated by the dashed lines in FIG. 6, that is, a state in which the discharge side of the air conditioning compressor 51 is connected to the gas sides of the indoor heat exchangers 72*a* to 72*d* via the gas-side shutoff valve 56 and the gas refrigerant connection tube 82 and in which suction side of the air conditioning compressor 51 is connected to the gas side of the outdoor heat exchanger 53. The opening degree of the outdoor expansion valve 63 is controlled so that it reduces the pressure of the refrigerant flowing into the outdoor heat exchanger 53 to a pressure (that is, the evaporation pressure Pe) at which the refrigerant is capable of being evaporated in the outdoor heat exchanger 53. Further, the liquid-side shutoff valve 55 and the gas-side shutoff valve 56 are placed in an open state. The opening degrees of indoor expansion valves 71*a* to 71*d* are controlled in such a way that degrees of subcooling SC of the refrigerant at the outlets of the indoor heat exchangers 72*a* to 72*d* becomes constant at a target degree of subcooling SCt. The target degree of subcooling SCt is set to an optimal temperature value in order for the room temperature Tr to converge on the set temperature Ts in a degree of subcooling range specified in accordance with the operating state at that time. In the present embodiment, the degree of subcooling SC of the refrigerant at the outlets of the indoor heat exchangers 72*a* to 72*d* is detected by converting a discharge pressure Pd of the air conditioning compressor 51 detected by the discharge pressure sensor 59 into the saturation temperature value corresponding to a condensation temperature Tc and subtracting the refrigerant temperature Tsc detected by the liquid-side temperature sensors 74*a* to 74*d* from this saturation temperature value of the refrigerant. Although it is not employed in the present embodiment, a temperature sensor that detect the temperature of the refrigerant flowing in the each of indoor heat exchangers 72*a* to 72*d* may also be disposed, and the degree of subcooling SC of the refrigerant at the outlets of the indoor heat exchangers 72*a* to 72*d* may also be detected by subtracting the refrigerant temperature values corresponding to the condensation temperature Tc detected by the temperature sensors from the refrigerant temperature Tsc detected by the liquid-side temperature sensors 74*a* to 74*d*.

When the air conditioning compressor 51, the outdoor fan 57, and the indoor fans 73*a* to 73*d* are operated in this state of the air conditioning refrigerant circuit 41, low-pressure gas refrigerant is sucked into the air conditioning compressor 51, compressed, and becomes high-pressure gas refrigerant. Then, the refregerant is sent to the indoor units 70*a* to 70*d* via the air conditioning four-way switching valve 52, the gas-side shutoff valve 56, and the gas refrigerant connection tube 82.

Then, the high-pressure gas refrigerant sent to the indoor units 70*a* to 70*d* is condensed by heat exchange with the room air and becomes high-pressure liquid refrigerant in the indoor heat exchangers 72*a* to 72*d*. Then its pressure is reduced in accordance with the valve opening degrees of the indoor expansion valves 71*a* to 71*d* when it passes through the indoor expansion valves 71*a* to 71*d*.

This refrigerant passing through the indoor expansion valves 71*a* to 71*d* is sent to the outdoor unit 50 via the liquid refrigerant connection tube 81, and is depressurized via the liquid-side shutoff valve 55 and the outdoor expansion valve 63, and flows into the outdoor heat exchanger 53. Then, the low-pressure refrigerant in the gas-liquid two-phase state that flows into the outdoor heat exchanger 53 is evaporated by heat exchange with the outdoor air supplied by the outdoor fan 57 and becomes low-pressure gas refrigerant. Then the refrigerant flows into the accumulator 54 via the air conditioning four-way switching valve 52. Thereafter, the low-pressure gas refrigerant that flows into the accumulator 54 is sucked into the air conditioning compressor 51 again.

(4) Controller (4-1) Configuration of Controller

Figure 7:
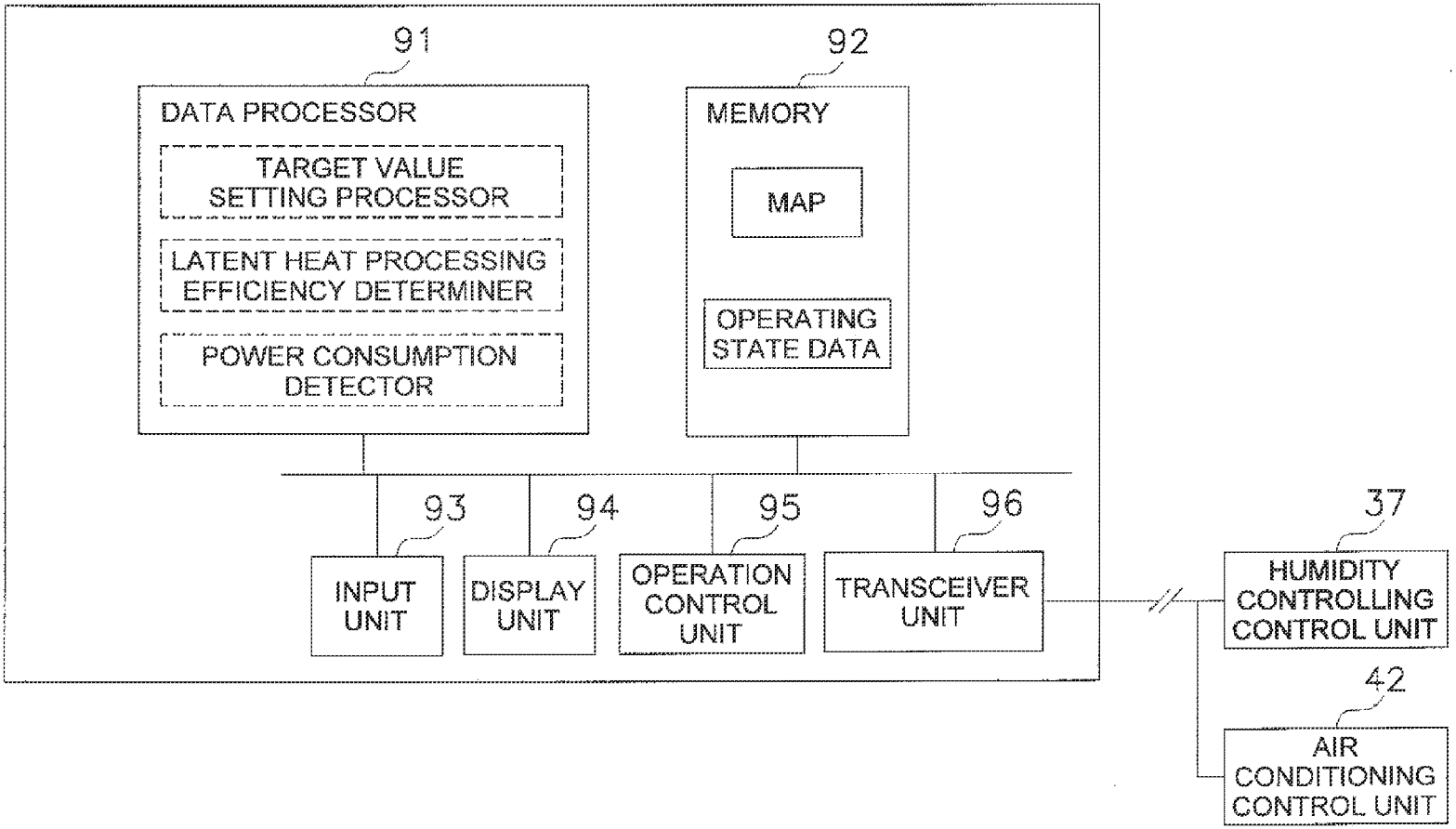
FIG. 7 is a schematic configuration diagram of a controller.

As shown in FIG. 7, the controller 90 is configured by a data processor 91, a memory 92 that serves as a storage unit, an input unit 93, a display unit 94, an operation control unit 95, and a transceiver unit 96. FIG. 7 is a schematic configuration diagram of the controller 90.

The data processor 91 is configured by a target value setting processor 91*a*, a latent heat processing efficiency determiner 91*b*, and a power consumption detector 91*c*. The target value setting processor 91*a* performs optimal target value setting processing that sets a target operating frequency of the humidity controlling compressor 24 and a target evaporation temperature of the indoor heat exchangers 72*a* to 72*d* and the like. The optimal target value setting processing is performed when a later-described power consumption minimizing control mode is set by the input unit 93. The latent heat processing efficiency determiner 91*b* determines whether or not the latent heat processing efficiency in the humidity control apparatus 20 falls. The power consumption detector 91*c* detects power consumption data of the humidity control apparatus 20 and power consumption data of the air conditioner 40 received by the transceiver unit 96 and calculates the total power consumption (power consumption in which the power consumption of the humidity control apparatus 20 and the power consumption of the air conditioner 40 are added up).

The memory 92 includes internal memories such as a RAM and a ROM and an external memory such as a hard disk. As described later, the memory 92 stores the total power consumption calculated by the power consumption detector 91*c*. Further, the memory 92 stores a map or a formula (a power consumption minimizing logic) for minimizing the power consumption and in which the total power consumption, the operating frequency of the humidity controlling compressor 24, the evaporation temperature in the indoor heat exchangers 72*a* to 72*d*, and operating conditions are associated with one another. The "operating conditions" here are conditions relating to the latent heat load and the sensible heat load in the room space RS, a target temperature and a target humidity of the room space RS, the room temperature and the room humidity of the room space RS, and the outside air temperature and the outside air humidity. The "operating conditions" may include not just the above-described conditions but also specification information relating to the specifications of the humidity control apparatus 20 and the air conditioner 40.

The input unit 93 may be a device for inputting, such as a keyboard and/or a mouse, or may be buttons or the like placed on the controller 90.

Although it is not shown in the drawings, the display unit 94 is a screen such as a liquid crystal display and is disposed in such a way that it is easy for the user to recognize the content of information.

The operation control unit 95 controls the various devices of the humidity control apparatus 20 and the air conditioner 40 on the basis of operation target values set by the data processor 91. For example, the operation control unit 95 issues a command to the humidity controlling control unit 37 to control the humidity controlling compressor 24 to achieve the target operating frequency of the humidity controlling compressor 24 and issues a command to the air conditioning control unit 42 to control the air conditioning compressor 51 and/or the indoor expansion valves 71*a* to 71*d* to achieve the target evaporation temperature of the indoor heat exchangers 72*a* to 72*d* set by the data processor 91.

The transceiver unit 96 is connected to the humidity controlling control unit 37 of the humidity control apparatus 20 and the air conditioning control unit 42 of the air conditioner 40 via a control line and transmits and receives various types of information.

(4-2) Control of Controller

Figure 8:
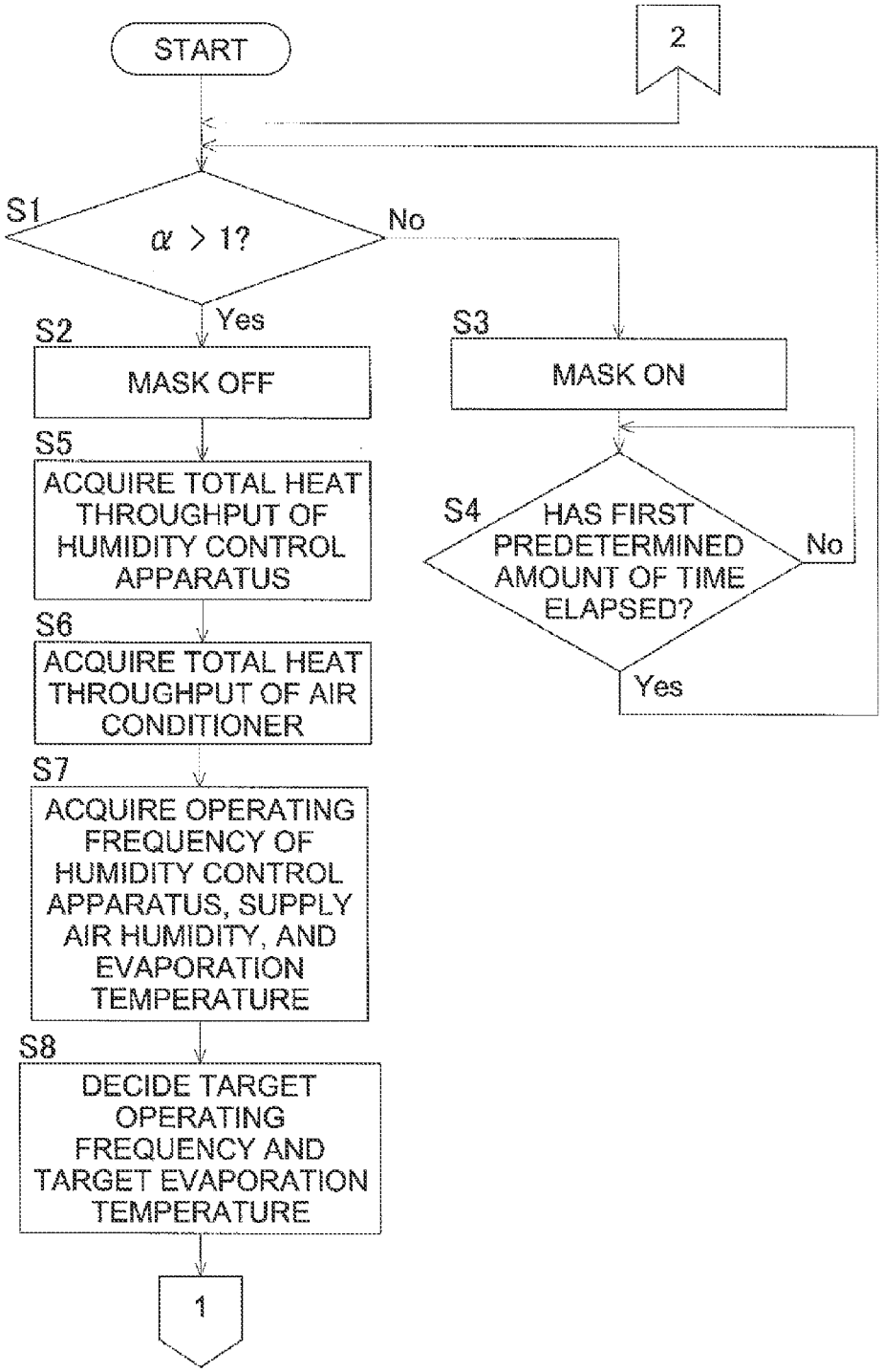
FIG. 8 is the first half of a flowchart showing a flow of processing of power consumption minimizing control.
Figure 9:
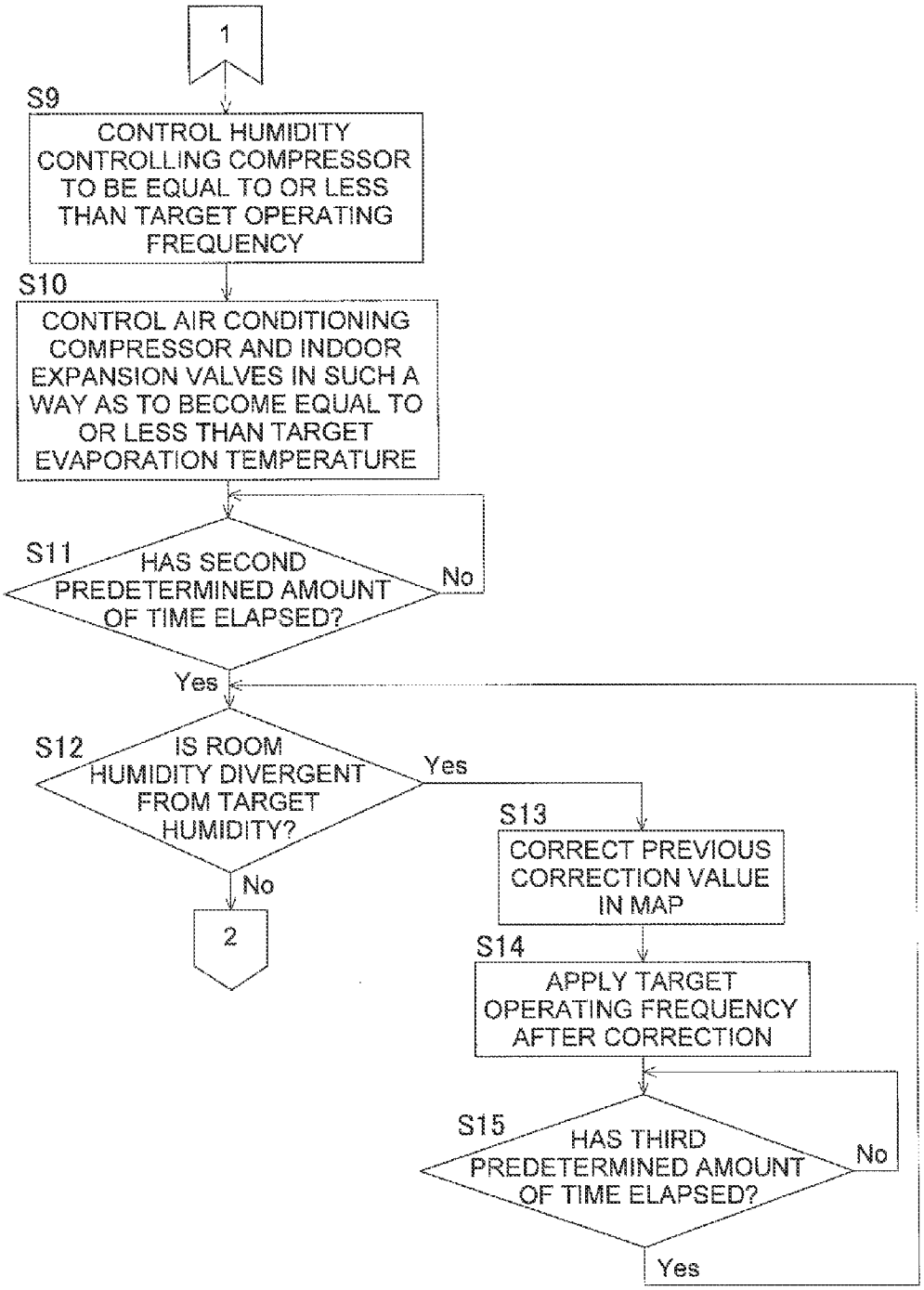
FIG. 9 is the second half of a flowchart showing a flow of processing of power consumption minimizing control.

The controller 90 performs power consumption minimizing control when it is set to a power consumption minimizing control mode by the input unit 93 in a case where the humidity control apparatus 20 is performing the dehumidifying operation and the air conditioner 40 is performing the cooling operation. The power consumption minimizing control will be described below using the flowchart of FIG. 8 and FIG. 9.

First, in step S1, the latent heat processing efficiency determiner 91*b* determines whether or not the latent heat load is being optimally processed with respect to the target temperature and the target humidity set by the user. Specifically, the latent heat processing efficiency determiner 91*b* determines that the latent heat processing efficiency in the humidity control apparatus 20 falls in a case where a value a obtained by dividing the difference (Hoa-Hsa) between the outside air humidity Hoa and the supply air humidity Hsa by the difference (Hoa-Hra) between the outside air humidity Hoa and the room humidity lira exceeds a predetermined value (in the present embodiment, 1). In a case where the latent heat processing efficiency determiner 91*b* determines that the latent heat processing efficiency falls (that is, in the case of $\alpha>1$), the controller 90 moves to step S2, and in a case where this is not so, the controller 90 moves to step S3.

In step S2, the controller 90 switches off a mask. The "switches off a mask" here is performing the optimal target value setting processing that sets the target operating frequency of the humidity controlling compressor 24 and the target evaporation temperature of the indoor heat exchangers 72*a* to 72*d* in such a way as to minimize the power consumption. When step S2 ends, the controller 90 moves to step S5.

In step S3, the controller 90 switches on the mask. The "switches on the mask" here is not performing the optimal target value setting processing that sets the target operating frequency of the humidity controlling compressor 24 and the target evaporation temperature of the indoor heat exchangers 72*a* to 72*d* in such a way as to minimize the power consumption. When step S3 ends, the controller 90 moves to step S4.

In step S4, the controller 90 determines whether or not a first predetermined amount of time has elapsed. In a case where the first predetermined amount of time has elapsed, the controller 90 returns to step S1, and in a case where this is not so, the controller 90 returns to step S4.

In step S5, the transceiver unit 96 receives the current total heat throughput (latent heat throughput+sensible heat throughput) of the humidity control apparatus 20 and stores it in the memory 92. Then, in step S6, the transceiver unit 96 receives the current total heat throughput (latent heat throughput+sensible heat throughput) of the air conditioner 40 and stores it in the memory 92. In step S7, the transceiver unit 96 receives the current operating frequency of the humidity controlling compressor 24, the current supply air humidity Hsa supplied from the humidity control apparatus 20 to the room space RS, and the current evaporation temperature of the indoor heat exchangers 72*a* to 72*d* and stores them in the memory 92.

In step S8, the target value setting processor 91*a* decides the target operating frequency of the humidity controlling compressor 24 and the target evaporation temperature of the air conditioner 40 with which the total power consumption will be minimized on the basis of the latent heat throughput and the sensible heat throughput of the humidity control apparatus 20, the total heat throughput of the air conditioner 40, the operating frequency of the humidity controlling compressor 24, the supply air humidity Hsa, and the evaporation temperature stored in the memory 92 in step S5 to step S7 and the map stored beforehand in the memory 92.

In step S9, on the basis of the target operating frequency of the humidity controlling compressor 24 decided in step S8, the operation control unit 95 issues a command to the humidity controlling control unit 37 to control the operating frequency of the humidity controlling compressor 24 in such a way that it becomes equal to or less than the target operating frequency. A previous correction value is added to the target operating frequency at this time.

In step S10, on the basis of the target evaporation temperature of the indoor heat exchangers 72*a* and 72*d* decided in step S8, the operation control unit 95 issues a command to the air conditioning control unit 42 to control the air conditioning compressor 51 and/or the indoor expansion valves 71*a* to 71*d* to achieve the target evaporation temperature or less.

In step S11, the controller 90 determines whether or not a second predetermined amount of time has elapsed. In a case where it is determined that the second predetermined amount of time has elapsed, the controller moves to the next step S12, and in a case where it is determined that the second predetermined amount of time has not elapsed, the controller 90 returns to step S11.

In step S12, the controller 90 determines whether or not the room humidity lira at that time is divergent from the target humidity of the room space RS. In a case where it is determined that the room humidity Hra is divergent from the target humidity of the room space RS, the controller 90 moves to step S13, and in a case where this is not so, the controller 90 returns to step S1.

In step S13, the controller 90 corrects the previous correction value for correcting the target operating frequency of the humidity controlling compressor 24 in the map in such a way that the room humidity Hra matches the target humidity of the room space RS. With the previous correction value, the controller 90 fine-tunes the target operating frequency of the humidity controlling compressor 24 in the map. That is, by adding the previous correction value decided in step S13 to the target operating frequency decided in step S8, the controller 90 can set an operating frequency with which the room humidity Hra matches the target humidity of the room space RS.

In step S14, the controller 90 uses, as the target operating frequency, the target operating frequency to which the previous correction value corrected in step S13 is applied and controls the operating frequency of the humidity controlling compressor 24 in such a way as to achieve the corrected target operating frequency or less.

In step S15, the controller 90 determines whether or not a third predetermined amount of time has elapsed. In a case where it is determined that the third predetermined amount of time has elapsed, the controller 90 returns to step S12, and in a case where this is not so, the controller 90 returns to step S15.

(5) Characteristics (5-1)

According to the controller 90 pertaining to the present embodiment, the controller 90 performs the optimal target value setting processing on the basis of the map or formula stored in the memory 92, so the controller 90 can quickly perform control that optimizes the balance between the latent heat throughput processed by the humidity control apparatus 20 and the latent heat throughput processed by the air conditioner 40 and the balance between the sensible heat throughput processed by the humidity control apparatus 20 and the sensible heat throughput processed by the air conditioner 40. Consequently, the controller 90 can suppress the power consumption pertaining to the humidity control apparatus 20 and the air conditioner 40 and can shorten the amount of time until it reduces the power consumption.

(5-2)

According to the controller 90 pertaining to the present embodiment, in a case where the room humidity Hra at that time is divergent from the target humidity of the room space RS set by the user, the controller 90 corrects the target operating frequency of the humidity controlling compressor 24 in the map or formula in such a way that the room humidity Hra becomes closer to the target humidity of the room space RS. For this reason, even if an excess or deficiency in the latent heat throughput were to arise with respect to the latent heat load of the entire room space RS, the controller 90 can revise the control state in such a way that the room humidity Hra reliably reach the target humidity of the room space RS by controlling the target operating frequency of the humidity controlling compressor 24.

(5-3)

According to the controller 90 pertaining to the present embodiment, the operation control unit 95 controls the humidity controlling compressor 24 to achieve the target operating frequency or less and controls the air conditioning compressor 51 and/or the indoor expansion valves 71*a* to 71*d* to achieve the target evaporation temperature or less.

In this way, the target operating frequency and the target evaporation temperature are not directly set as fixed values, so the state can be made automatically controllable when the latent heat load or the sensible heat load fluctuates in a short amount of time. For example, in a case where the latent heat load decreases in a short amount of time, the controller 90 can control the latent heat throughput processed by the humidity control apparatus 20 and reduce power consumption resulting from excess processing by lowering the operating frequency of the humidity control apparatus in accordance with the decreased latent heat load. Further, for example, in a case where the number of room occupants suddenly increase and the sensible heat load suddenly increase due to a change in the set temperature by a remote controller or the like, the controller 90 can increase the sensible heat throughput processed by the air conditioner and eliminate a deficiency in performance by lowering the target evaporation temperature.

(5-4)

According to the controller 90 pertaining to the present embodiment, the latent heat processing efficiency determiner 91*b* determines whether or not the latent heat processing efficiency in the humidity control apparatus 20 falls, and in a case where it is determined that the latent heat processing efficiency in the humidity control apparatus 20 falls, the target value setting processor 91*a* switches on the mask without performing the optimal target value setting processing. The humidity control apparatus 20 has the two adsorption heat exchangers 22 and 23 and periodically switches between adsorption processing that adsorbs moisture from the outside air and regeneration processing that uses inlet air from the predetermined space to cause the moisture adsorbed by the adsorption heat exchangers to evaporate (batch switching). Consequently, in a case where the latent heat generated in the room space RS is large, the efficiency of the regeneration processing falls and the latent heat processing by the humidity control apparatus falls.

In this way, the controller does not perform the optimal target value setting processing in a case where the latent heat processing efficiency in the humidity control apparatus 20 falls, so the controller can stabilize the air conditioning processing by the humidity control apparatus 20 and the air conditioner 40 and can prevent a drop in efficiency caused by continuing the optimal target value setting processing.

(6) Modifications (6-1) Modification A

In the above-described embodiment, the air conditioning processing system controls the humidity control apparatus 20 and the air conditioner 40 placed in one space with the one controller 90, but the air conditioning processing system is not limited to this and may also divide humidity control apparatus 20 and air conditioners 40 placed plural places by each space and control them with one controller.

(6-2) Modification B

In the above-described embodiment, the controller 90 performs the optimal target value setting processing on the basis of a map stored beforehand in the memory 92, but the controller 90 is not limited to this and may also optimally control the balance between the latent heat throughput processed by the humidity control apparatus 20 and the latent heat throughput processed by the air conditioner 40 and the balance between the sensible heat throughput processed by the humidity control apparatus 20 and the sensible heat throughput processed by the air conditioner 40 in such a way as to minimize the total power consumption by performing first processing that lowers the target operating frequency of the humidity controlling compressor 24 and lowers the target evaporation temperature in the indoor heat exchangers 72*a* to 72*d* or performing second processing that raises the target operating frequency and raises the target evaporation temperature. By performing the first processing, the controller 90 can make the air conditioner 40 process part of the latent heat load to be processed by the humidity control apparatus 20, and by performing the second processing, the controller 90 can make the humidity control apparatus 20 process part of the latent heat load to be processed by the air conditioner 40. For this reason, the controller 90 can suppress the power consumption pertaining to the humidity control apparatus 20 and the air conditioner 40.

Further, in regard to the sensible heat throughput of the entire room space RS, even if the sensible heat throughput processed by the humidity control apparatus 20 increases or decreases, the air conditioner 40 can perform sensible heat processing in accordance with the residual sensible heat throughput since the controller 90 controls the target evaporation temperature of the indoor heat exchangers 72*a* to 72*d*. For this reason, the temperature of the room space RS can be easily maintained at the target temperature.

(6-3) Modification C

In the above-described embodiment, the controller 90 controls the latent heat throughput of the humidity control apparatus 20 by controlling the operating frequency of the humidity controlling compressor 24, but the controller 90 is not limited to this and may also control the latent heat throughput of the humidity control apparatus 20 by controlling the batch time to switch the humidity controlling four-way switching valve 25 or may also control the latent heat throughput of the humidity control apparatus 20 by executing these controls in parallel.

(6-4) Modification D

Although it is not referred to in the above-described embodiment, the data processor 91 of the controller 90 may be further equipped with a logic updater 91*d*, and the logic updater 91*d* may update the map or formula stored in the memory 92 to an optimal power consumption map (or formula) received by the transceiver unit 96. Specifically, the transceiver unit 96 is connected to a network and transmits operating state data of the humidity control apparatus 20 or the air conditioner 40 to a remotely located network center via the network. The network center creates an optimal power consumption map so as to become more optimal on the basis of the operating state data. Additionally, the logic updater 91*d* updates the map stored in the memory 92 to the optimal power consumption minimizing map received by the transceiver unit 96.

For example, in a case where correction is frequently performed with respect to the existing map or formula stored in the memory 92, there are cases where it takes time until the controller minimizes the power consumption and efficiency becomes worse. In a case where correction is frequently per with respect to the map or formula in this way, the controller downloads the optimal power consumption minimizing map that is created by the network center and suited to the installation conditions of the humidity control apparatus 20 and the air conditioner 40 and updates the map or formula stored in the memory 92 to the optimal power consumption minimizing map. The network center collects the operating states of the humidity control apparatus 20 and the air conditioner 40 and creates an power consumption minimizing map suited to the installed humidity control apparatus 20 and air conditioner 40 as the optimal power consumption minimizing map.

Consequently, the controller can utilize the power consumption minimizing map suited to the humidity control apparatus 20 and air conditioner 40 installed in that location for performing the optimal target value setting processing and can precisely perform the optimal target value setting processing.

(6-5) Modification E

In the above-described embodiment, the controller 90 acquires the outside air temperature Toa and the outside air humidity Hoa with sensors, but, in a state in which the controller 90 is connected to a network like in modification D, the controller 90 may also employ an outside air temperature Toa and an outside air humidity Hoa forecast from weather forecast information received by the transceiver unit 96 for setting the target operating frequency and the target evaporation temperature.

For this reason, for example, on start-up or in a case where a certain amount of time is required until the system stabilizes after control values is changed, the controller can employ an accurate outside air temperature Toa. Thus, the controller can perform the optimal target value setting processing quickly and precisely.

(6-6) Modification F

In the above-described embodiment, the controller 90 controls the humidity controlling compressor 24 to achieve the target operating frequency or less, controls the air conditioning compressor 51 and/or the indoor expansion valves 71*a* to 71*d* to achieve the target evaporation temperature or less, and utilizes the target operating frequency and the target evaporation temperature as maximum control values, but the controller 90 is not limited to this and may also utilize the target operating frequency and the target evaporation temperature as fixed values.

What is claimed is:

1. A controller configured to control operations of a humidity control apparatus arranged and configured to perform humidity control processing of a predetermined space, the humidity control apparatus including a humidity controlling refrigerant circuit having a humidity controlling compressor, a first adsorption heat exchanger, a second adsorption heat exchanger, a humidity controlling expansion mechanism, and a switching mechanism interconnected to each other, the switching mechanism being switchable between a first switched state allowing refrigerant discharged from the humidity controlling compressor to circulate in order through the first adsorption heat exchanger, the humidity controlling expansion mechanism, and the second adsorption heat exchanger and a second switched state allowing the refrigerant discharged from the humidity controlling compressor to circulate in order through the second adsorption heat exchanger, the humidity controlling expansion mechanism, and the first adsorption heat exchanger, and an air conditioner arranged and configured to perform air conditioning processing of the predetermined space, the air conditioner including an air conditioning refrigerant circuit having at least an air conditioning compressor, a heat source-side heat exchanger, a utilization-side heat exchanger, and an air conditioning expansion mechanism interconnected to each other, the controller comprising:

a power consumption detector arranged and configured to detect a power consumption of the humidity control apparatus and the air conditioner, which perform both latent heat processing and sensible heat processing of the predetermined space;

a target value setting processor configured to perform one of a first processing lowering a target operating frequency of the humidity controlling compressor and lowering a target evaporation temperature in the utilization-side heat exchanger, and a second processing raising the target operating frequency and raising the target evaporation temperature, in order to perform optimal target value setting processing in which the target operating frequency and the target evaporation temperature are set so as to minimize the power consumption; and an operation control unit configured to control the humidity controlling compressor to achieve the target operating frequency and at least one of the air conditioning compressor and the air conditioning expansion mechanism to achieve the target evaporation temperature, the first processing resulting in the air conditioner processing part of a latent heat load mainly processed by the humidity control apparatus, and the second processing resulting in the humidity control apparatus processing part of a sensible heat load mainly processed by the air conditioner.

2. The controller according to claim 1, further comprising a storage unit configured to store a power consumption minimizing logic, with the operating frequency of the humidity controlling compressor, the evaporation temperature in the utilization-side heat exchanger, the power consumption, and operating conditions being associated with each other in the power consumption minimizing logic, the target value setting processor setting the target operating frequency and the target evaporation temperature based on the operating conditions at that time and the power consumption minimizing logic.

3. The controller according to claim 2, wherein the operating conditions relate to a latent heat load and a sensible heat load in the predetermined space, a target temperature and a target humidity of the predetermined space, a space temperature and a space humidity of the predetermined space, and an outside air temperature and an outside air humidity.

4. The controller according to claim 2, wherein in a case where it is determined that humidity of the predetermined space at that time is divergent from the target humidity of the predetermined space, the controller is configured to correct the target operating frequency of the humidity controlling compressor in the power consumption minimizing logic such that the humidity of the predetermined space matches the target humidity of the predetermined space.

5. The controller according to claim 2, further comprising a transceiver unit connected to a network, the transceiver unit being configured to transmit operating state data of one of the humidity control apparatus and the air conditioner to a remotely located network center via the network, and to receive an optimal power consumption minimizing logic, the optimal power consumption minimizing logic being updated so as to become more optimal than the power consumption minimizing logic based on the operating state data; and a logic updater configured to update the power consumption minimizing logic to the optimal power consumption minimizing logic that the transceiver unit receives.

6. The controller according to claim 5, wherein the transceiver unit is further configured to receive weather forecast information, and the target value setting processor is further configured to employ the received weather forecast information as the outside air temperature and the outside air humidity as two of the operating conditions to set the target operating frequency and the target evaporation temperature.

7. The controller according to claim 1, wherein the operation control unit is further configured to control the humidity controlling compressor to achieve no more than the target operating frequency and at least one of the air conditioning compressor and the air conditioning expansion mechanism to achieve no more than the target evaporation temperature.

8. A controller configured to control operations of a humidity control apparatus arranged and configured to perform humidity control processing of a predetermined space, the humidity control apparatus including a humidity controlling refrigerant circuit having a humidity controlling compressor, a first adsorption heat exchanger, a second adsorption heat exchanger, a humidity controlling expansion mechanism, and a switching mechanism interconnected to each other, the switching mechanism being switchable between a first switched gate allowing refrigerant discharged from the humidity controlling compressor to circulate in order through the first adsorption heat exchanger, the humidity controlling expansion mechanism, and the second adsorption heat exchanger and a second switched state allowing the refrigerant discharged from the humidity controlling compressor to circulate in order through the second adsorption heat exchanger, the humidity controlling expansion mechanism, and the first adsorption heat exchanger, and an air conditioner arranged and configured to perform air conditioning processing of the predetermined space, the air conditioner including an air conditioning refrigerant circuit having at least an air conditioning compressor, a heat source-side heat exchanger, a utilization-side heat exchanger, and an air conditioning expansion mechanism interconnected to each other, the controller comprising:

a power consumption detector arranged and configured to detect a power consumption of the humidity control apparatus and the air conditioner;

a target value setting processor configured to perform one of a first processing lowering a target operating frequency of the humidity controlling compressor and lowering a target evaporation temperature in the utilization-side heat exchanger, and a second processing raising the target operating frequency and raising the target evaporation temperature, in order to perform optimal target value setting processing in which the target operating frequency and the target evaporation temperature are set so as to minimize the power consumption;

an operation control unit configured to control the humidity control hog compressor to achieve the target operating frequency and at least one of the air conditioning compressor and the air conditioning expansion mechanism to achieve the target evaporation temperature; and a latent heat processing efficiency determiner configured to determine whether the latent heat processing efficiency in the humidity control apparatus falls, the target value setting processor being further configured to not perform the optimal target value setting processing in a case where it is determined that the latent heat processing efficiency in the humidity control apparatus falls.

9. The controller according to claim 8, wherein the latent heat processing efficiency determiner determines that the latent heat processing efficiency in the humidity control apparatus fails in a case where a value obtained by dividing a difference between an absolute humidity of outside air and an absolute humidity of outlet air blown out into the predetermined space from the humidity control apparatus by a difference between the absolute humidity of the outside air and an absolute humidity of the predetermined space exceeds a predetermined value.

10. An air conditioning processing system comprising:

a humidity control apparatus arranged and configured to perform humidity control processing of a predetermined space, the humidity control apparatus including a humidity controlling refrigerant circuit having a humidity controlling compressor, a first adsorption heat exchanger, a second adsorption heat exchanger, a humidity controlling expansion mechanism, and a switching mechanism interconnected to each other, the switching mechanism being switchable between a first switched state allowing refrigerant discharged from the humidity controlling compressor to circulate in order through the first adsorption heat exchanger, the humidity controlling expansion mechanism, and the second adsorption heat exchanger and a second switched state allowing the refrigerant discharged from the humidity controlling compressor to circulate in order through the second adsorption heat exchanger, the humidity controlling expansion mechanism, and the first adsorption heat exchanger;

an air conditioner arranged and configured to perform air conditioning processing of the predetermined space, the air conditioner including an air conditioning refrigerant circuit having at least an air conditioning compressor, a heat source-side heat exchanger, a utilization-side heat exchanger, and an air conditioning expansion mechanism interconnected to each other; and a controller including a power consumption detector arranged and configured to detect a power consumption of the humidity control apparatus and the air conditioner, which perform both latent heat processing and sensible heat processing of the predetermined space, a target value setting processor configured to perform one of a first processing lowering a target operating frequency of the humidity controlling compressor and lowering a target evaporation temperature in the utilization-side heat exchanger, and a second processing raising the target operating frequency and raising the target evaporation temperature, in order to perform optimal target value setting processing in which the target operating frequency and the target evaporation temperature are set so as to minimize the power consumption, and an operation control unit configured to control the humidity controlling compressor to achieve the target operating frequency and at least one of the air conditioning compressor and the air conditioning expansion mechanism to achieve the target evaporation temperature, the first processing resulting in the air conditioner processing part of a latent heat load mainly processed by the humidity control apparatus, and the second processing resulting in the humidity control apparatus processing part of a sensible heat load mainly processed by the air conditioner.

11. The controller according to claim 2, wherein the operation control unit is further configured to control the humidity controlling compressor to achieve no more than the target operating frequency and at least one of the air conditioning compressor and the air conditioning expansion mechanism to achieve no more than the target evaporation temperature.

12. The controller according to claim 8, further comprising a storage unit configured to store a power consumption minimizing logic, with the operating frequency of the humidity controlling compressor, the evaporation temperature in the utilization-side heat exchanger, the power consumption, and operating conditions being associated with each other in the power consumption minimizing logic, the target value setting processor setting the target operating frequency and the target evaporation temperature based on the operating conditions at that time and the power consumption minimizing logic.

13. The controller according to claim 8, wherein the operating control unit is further configured to control the humidity controlling compressor to achieve no more than the target operating frequency and at least one of the air conditioning compressor and the air conditioning expansion mechanism to achieve no more than the target evaporation temperature.

14. The controller according to claim 3, wherein in a case where it is determined that humidity of the predetermined space at that time is divergent from the target humidity of the predetermined space, the controller is configured to correct the target operating frequency of the humidity controlling compressor in the power consumption minimizing logic such that the humidity of the predetermined space matches the target humidity of the predetermined space.

15. The controller according to claim 3, further comprising a transceiver unit connected to a network, the transceiver unit being configured to transmit operating state data of one of the humidity control apparatus and the air conditioner to a remotely located network center via the network, and to receive an optimal power consumption minimizing logic, the optimal power consumption minimizing logic being updated so as to become more optimal than the power consumption minimizing logic based on the operating state data; and a logic updater configured to update the power consumption minimizing logic to the optimal power consumption minimizing logic that the transceiver unit receives.

16. The controller according to claim 4, further comprising a transceiver unit connected to a network, the transceiver unit being configured to transmit operating state data of one of the humidity control apparatus and the air conditioner to a remotely located network center via the network, and to receive an optimal power consumption minimizing logic, the optimal power consumption minimizing logic being updated so as to become more optimal than the power consumption minimizing logic based on the operating state data; and a logic updater configured to update the power consumption minimizing logic to the optimal power consumption minimizing logic that the transceiver unit receives.

* * * * *